US011641923B2

(12) United States Patent
Maurin et al.

(10) Patent No.: US 11,641,923 B2
(45) Date of Patent: May 9, 2023

(54) COSMETIC CONTAINER WITH A CAPPED SEAL

(71) Applicant: HCT GROUP HOLDINGS LIMITED, Sheung Wan (CN)

(72) Inventors: Denis Pierre Maurin, Los Angeles, CA (US); Thomas Sang Chun, Buena Park, CA (US); Lewis On Hang Lee, Encino, CA (US)

(73) Assignee: HCT GROUP HOLDINGS LIMITED, Hong Kong (CN)

( * ) Notice: Subject to any disclaimer, the term of this patent is extended or adjusted under 35 U.S.C. 154(b) by 597 days.

(21) Appl. No.: 16/677,074

(22) Filed: Nov. 7, 2019

(65) Prior Publication Data

US 2020/0138170 A1 May 7, 2020

Related U.S. Application Data

(60) Provisional application No. 62/910,606, filed on Oct. 4, 2019, provisional application No. 62/756,949, filed on Nov. 7, 2018.

(51) Int. Cl.
*A45D 40/00* (2006.01)

(52) U.S. Cl.
CPC ..... *A45D 40/00* (2013.01); *A45D 2040/0025* (2013.01)

(58) Field of Classification Search
CPC ..... A45D 34/04; A45D 34/041; A45D 34/06; A45D 40/00; A45D 40/24; A45D 40/26; A45D 40/262; A45D 2034/002; A45D 2200/051; A45D 2200/054; A45D 2200/1009; A45D 2200/1018; A45D 2040/0025; B65D 35/22; B65D 35/242; B65D 51/222; B65D 2251/0096; B65D 2251/0015; A46B 2200/1053; A46B 9/021
USPC ..... 206/1.5; 401/1–2, 183, 129, 18, 17, 202, 401/25, 261–262, 265–266; 132/218, 132/73.5
See application file for complete search history.

(56) References Cited

U.S. PATENT DOCUMENTS 831,133 A * 9/1906 Anderson ..... A61J 11/008 215/12.2
2,458,063 A * 1/1949 Dulberg ..... A45D 34/06 206/229

(Continued)

FOREIGN PATENT DOCUMENTS

JP 2005029243 A * 2/2005
JP 2011218046 A * 11/2011

OTHER PUBLICATIONS

International Search Report and Written Opinion dated Apr. 9, 2020, for International Application No. PCT/US2019/060259.

*Primary Examiner* — Chun Hoi Cheung
*Assistant Examiner* — Brijesh V. Patel
(74) *Attorney, Agent, or Firm* — Seager, Tufte & Wickhem LLP

(57) ABSTRACT

A cosmetic container may comprise a tubular sleeve that defines a cavity. The tubular sleeve may include a first end with a first opening and a second end with a second opening. The first opening may be defined by at least one upper sidewall which may include outer threads. The cosmetic container may include a cap assembly which may be configured to engage with the second opening of the second end, thereby sealing the second opening of the second end.

11 Claims, 24 Drawing Sheets

(56) References Cited

U.S. PATENT DOCUMENTS 2,671,577 A * 3/1954 Remington ..... B67B 7/24 222/92
2,964,045 A * 12/1960 Carl ..... A45D 40/265 206/229
3,071,281 A * 1/1963 Sawai ..... B65D 15/14 220/916
3,124,264 A * 3/1964 Waisberg ..... B65D 1/06 215/205
4,545,491 A * 10/1985 Bisgaard ..... A61J 9/04 215/11.5
4,685,820 A * 8/1987 Kremer ..... B43M 11/08 401/206
4,828,126 A * 5/1989 Vincinguerra ..... A61J 9/04 215/11.1
5,464,122 A * 11/1995 Lifshey ..... A61F 9/0008 401/262
5,499,729 A * 3/1996 Greenwood ..... A45D 40/24 401/24
5,509,742 A * 4/1996 Balzarini ..... A45D 40/267 401/23
5,586,694 A * 12/1996 Breidenbach ..... A45D 34/041 401/214
5,620,270 A * 4/1997 Gueret ..... A45D 40/24 401/24
5,829,607 A * 11/1998 Ibrahim ..... B65D 1/0223 215/354
5,970,989 A * 10/1999 Litton ..... A45D 40/18 132/218
6,026,825 A * 2/2000 de Laforcade ..... A46B 3/18 401/122
6,210,621 B1 4/2001 Usen et al.
6,328,040 B1 * 12/2001 Stein ..... A45D 40/04 132/74.5
6,450,179 B2 * 9/2002 Bengis ..... A63H 33/28 132/297
6,543,458 B1 * 4/2003 Ohba ..... A45D 40/06 401/122
6,637,963 B2 * 10/2003 Huang ..... A46B 15/0059 132/316
6,945,419 B2 * 9/2005 Bertazza ..... A45D 40/265 220/23.91
9,022,042 B1 * 5/2015 Fichtl ..... A45D 40/24 132/297
9,510,659 B2 * 12/2016 Lim ..... A45D 34/045
10,829,271 B1 * 11/2020 Bulla ..... B65D 43/0231
2002/0162863 A1 * 11/2002 Brincat ..... B65D 11/04 222/568
2003/0053839 A1 * 3/2003 Dumler ..... A45D 40/24 401/17
2003/0178427 A1 9/2003 Chomik
2005/0019084 A1 * 1/2005 Gueret ..... A45D 34/06 401/25
2006/0198686 A1 * 9/2006 Hetzel ..... A45D 34/00 401/47
2007/0177930 A1 * 8/2007 Byun ..... A45D 33/02 401/278
2007/0292195 A1 12/2007 May et al.
2010/0143022 A1 * 6/2010 Shih ..... A45D 34/042 401/136
2010/0310298 A1 * 12/2010 Tsai ..... A46B 11/001 401/269
2011/0030718 A1 * 2/2011 Gueret ..... A45D 40/262 401/122
2011/0190672 A1 * 8/2011 Apodaca ..... A61H 1/00 601/17
2011/0309083 A1 * 12/2011 Hsiu-Tzu Charlene ..... A45D 34/00 206/459.5
2012/0014738 A1 * 1/2012 Heidenreiter ..... A45D 40/268 220/4.03
2012/0048824 A1 * 3/2012 Chevalier ..... A45D 40/267 215/41
2013/0098944 A1 * 4/2013 Broadney ..... B05B 11/0037 222/321.9
2013/0189017 A1 * 7/2013 Thiebaut ..... A45D 40/26 401/143
2014/0133895 A1 * 5/2014 Dockery ..... A45D 29/007 401/196
2014/0234003 A1 * 8/2014 Thorpe ..... A45D 34/04 132/73.5
2014/0348566 A1 11/2014 Uehara et al.
2014/0376984 A1 12/2014 Villarreal et al.
2015/0053233 A1 * 2/2015 Lim ..... A45D 40/18 132/218
2016/0374457 A1 * 12/2016 Golding ..... A45D 34/045 401/129
2017/0105507 A1 * 4/2017 Golding ..... A46B 9/021
2018/0153275 A1 * 6/2018 Hasegawa ..... A45D 40/262
2019/0045904 A1 * 2/2019 Maurin ..... A45D 34/04

* cited by examiner

COSMETIC CONTAINER WITH A CAPPED SEAL

CROSS REFERENCE TO RELATED APPLICATIONS

The present application claims the benefit of and priority to U.S. Provisional Patent Application No. 62/756,949, filed Nov. 7, 2018 and titled COSMETIC CONTAINER WITH A CAPPED SEAL, and as U.S. Provisional Patent Application No. 62/910,606, filed Oct. 4, 2019 and titled COSMETIC CONTAINER WITH A CAPPED SEAL, the disclosures of each of which are incorporated herein by reference.

TECHNOLOGY FIELD

The present application relates generally to a cosmetic container, and in particular, a cosmetic container with a capped seal, and to methods of manufacturing cosmetic containers.

BACKGROUND

Devices exist for holding cosmetic or medicinal products. Some such devices comprise a tubular shell or bottle for holding a product, and a cap for closing the tube or bottle. In the cosmetics and personal care industries, these devices are used for containing a product to be applied to a body. Exemplary products include liquids, creams, gels, and various makeup and skincare products such as foundation, concealer, lotion serum, petroleum products, moisturizer, sunscreen, etc. For such devices, the construction may include an extruded tube with a molded structure on one end adapted to receive an applicator and cap, leaving the other end open for filling with a cosmetic or medicinal product. Once the tubular shell has been filled with the product, the tubular shell is typically crimped shut. The crimping process deforms the tubular shell which reduces the volume of the tubular shell, thereby effectively reducing the amount of product that can be contained within the tubular shell. Greater volume may be desirable, as well as alternative aesthetics and the ability to stand the container on its closed end. Accordingly, there remains a need for improved cosmetic containers and alternative manufacturing processes.

SUMMARY

This disclosure provides design, material, manufacturing methods, and use alternatives for cosmetic packaging.

In a first example, a cosmetic container may include a tubular sleeve which may define a cavity. The tubular sleeve may include a first end with a first opening and a second end with a second opening. The first opening may be defined by at least one upper sidewall which may include an inner side and an outer side and a lower end. The outer side may include outer threads or other connection structure, and the lower end may include an opening. The cosmetic container may include a cap assembly including a cap ring and a cap for placement at the second opening. The cap ring may include an inner side and an outer side, and the outer side may include outer threads. The cap ring may be adapted for placement adjacent to the second end of the tubular sleeve. In some examples the cap ring may be formed onto the tubular sleeve as by injection molding. The cap may have a bottom and an outer wall. The outer wall may include inner threads which may be configured to engage with the outer threads of the outer side of the cap ring. The second opening may allow access to the cavity of the tubular sleeve.

Alternatively or additionally to any of the examples above, in another example, engagement of the inner threads of the cap with the outer threads of the cap ring may seal the second end of the tubular sleeve.

Alternatively or additionally to any of the examples above, in another example, disengagement of the inner threads of the cap with the outer threads of the cap ring may open the second end of the tubular sleeve.

Alternatively or additionally to any of the examples above, in another example, an O-ring may be adapted for placement around the cap ring to provide a seal between the cap ring and the cap.

Alternatively or additionally to any of the examples above, in other example, the cap may include an inner wall. The inner wall may be adapted to engage with the second opening of the second end of the tubular sleeve. For example, the inner wall may extend into the cavity defined inside the tubular sleeve.

Alternatively or additionally to any of the examples above, in another example, the cap ring may include an annular ridge and a channel may be located between the annular ridge and the outer threads which may receive the O-ring, and the O-ring may have a thickness that is greater than the width between an inner wall of the cap and the channel of the cap ring to provide the seal.

In another example, a cosmetic container may include a tubular sleeve which may define a cavity. The tubular sleeve may include a first end with a first opening and a second end with a second opening. The first opening may be defined by at least one upper sidewall which may include an inner side and an outer side and a lower end. The outer side may include outer threads and the lower end may include an opening. The cosmetic container may include a cap assembly including an inner plug and an outer cap. The inner plug may be adapted to engage with the second opening. The inner plug may include cylindrical sidewalls and an upper closed end which may extend into the cavity of the tubular sleeve. The inner plug may include a lower open end which may include an outer ridge configured to engage with the second end of the tubular sleeve. The outer ridge may provide a stop for the inner plug, and the cylindrical sidewalls may adapted to engage with the tubular sleeve. The outer cap may have a bottom and an outer wall. The outer wall may include a first inner ridge configured to engage with the outer ridge of the inner plug. The second opening may allow access to the cavity of the tubular sleeve.

Alternatively or additionally to any of the examples above, in another example, engagement of the first inner ridge of the outer cap and the outer ridge of the inner plug may seal the second end of the tubular sleeve.

Alternatively or additionally to any of the examples above, in another example, disengagement of the inner ridge of the outer cap and the outer ridge of the inner plug may open the second end of the tubular sleeve.

Alternatively or additionally to any of the examples above, in another example, the outer cap may include an inner wall, and the inner wall may be adapted to engage with an inside of the inner plug.

Alternatively or additionally to any of the examples above, in another example, the inner plug may include a groove on an outer surface of the cylindrical sidewalls.

Alternatively or additionally to any of the examples above, in another example, an O-ring may be adapted to engage with the groove and may provide a friction fit between the inner plug and the tubular sleeve.

Alternatively or additionally to any of the examples above, in another example, the outer wall of the outer cap may include a second inner ridge. The first inner ridge may be placed below the second inner ridge along the outer wall, such that to place the outer cap over the inner plug and the tubular sleeve, the second outer ridge must first pass over the outer ridge and then the first outer ridge must pass over the outer ridge. The second outer ridge may pass over the O-ring before the first outer ridge passes over the outer ridge, as the outer cap is placed over the inner plug and second end of the tubular sleeve.

Alternatively or additionally to any of the examples above, in another example, the outer cap may engage with the inner plug in a snap-fit fashion.

Alternatively or additionally to any of the examples above, in another example, the outer wall of the outer cap may include a second inner ridge. The first inner ridge may be below the second inner ridge along the outer wall, such that to place the outer cap over the inner plug and the tubular sleeve, the second outer ridge may first pass over the outer ridge and then the second outer ridge may pass over the outer ridge.

Alternatively or additionally, the outer cap may further include an inner wall adapted to extend into the inner plug, stopping at or short of the upper closed end thereof.

Alternatively or additionally to any of the examples above, in another example, a cosmetic container may include a tubular sleeve which may define a cavity. The tubular sleeve may include a first end with a first opening and a second end with a second opening. The first opening may be defined by at least one upper sidewall which may include an inner side and an outer side and a lower end. The outer side may include outer threads and the lower end may include an opening, which may allow access to the cavity of the tubular sleeve. The cosmetic container may include a cap assembly including an inner cap and an outer cap. The inner cap may be adapted to engage with the second opening. The inner cap may include an inner wall and an outer wall which may be separated by a gap and joined by a lower rim. The outer wall may include a tab and an upper ridge. The inner wall may include a slot on an inner side of the inner wall, and the inner wall may be configured to extend into the cavity of the tubular sleeve. The lower rim may provide a stop for the inner cap. The outer cap may have a bottom, an inner wall and an outer wall. The inner wall may be adapted to engage with an inside of the inner cap. The outer wall may have an inner slot which may be configured to engage with the tab of the outer wall of the inner cap. The inner wall may have an outer ridge which may be configured to engage with the slot of the inner side of the inner wall. The inner cap may be attached for example by heat welding to the tubular sleeve, sealing the inner cap to the tubular sleeve prior to filling, and then the outer cap is attached thereover to hide the inner cap and seal the tubular sleeve following filling.

Alternatively or additionally to any of the examples above, in another example, engagement of the inner slot of the outer cap and the tab of the inner cap may seal the second end of the tubular sleeve.

Alternatively or additionally to any of the examples above, in another example, disengagement of the inner slot of the outer cap and the tab of the inner cap may open the second end of the tubular sleeve.

Alternatively or additionally to any of the examples above, in another example, the inner cap may be heat-welded to the tubular sleeve.

Alternatively or additionally to any of the examples above, in another example, the outer cap may engage with the inner cap in a snap-fit fashion.

Alternatively or additionally to any of the examples above, in another example, the outer cap may be threaded on to the inner cap.

Alternatively or additionally to any of the examples above, in another example, a method of filling a cosmetic container may include forming a tubular sleeve. The method may include filling the tubular sleeve with a cosmetic product and sealing the tubular sleeve with a cap assembly.

Alternatively or additionally to any of the examples above, in another example, a cosmetic container may include a tubular sleeve which may define a cavity. The tubular sleeve may have a first end with a first opening, and a second end with a second opening. The first opening may be defined by at least one upper sidewall, which may have an inner side and an outer side, and the outer side may include outer threads or other engagement structure. The first opening may include a receiving portion. The cosmetic container may further include a first applicator having an aperture. The first applicator may be configured to engage with the receiving portion at the first end of the tubular sleeve, such as by screwing on or snap-on. The cosmetic container may include a cap assembly which may have an inner cap and an outer cap. The inner cap may be adapted for placement adjacent the second end of the tubular sleeve, and the inner cap may have outer threads on an outer side of the inner cap. The outer cap may have a bottom and an outer wall, the outer wall may have inner threads which may be configured to engage with the outer threads of the outer side of the inner cap. The outer cap may include a stem which may be configured to extend into the cavity of the tubular sleeve. The second opening of the tubular sleeve may allow access to the cavity of the tubular sleeve. As an illustration, the first opening structure, including the receiving structure and outer side with threads, may be formed by inserting an extruded tube into a mold over a mandrel having a tapered end, and adding material via insert molding to form the receiving structure, outer side and threads onto the tube. The inner cap may be separately formed and placed inside the second end of the extruded tube, whereupon heat and/or pressure can be applied to secure the inner cap to the second end of the extruded tube. In an alternative, the inner cap at the second end of the tube may be formed first by insert molding the inner cap, and then placing a separately formed top piece inside the first end of the extruded tube and applying heat and/or pressure to secure the first end of the tube onto the top piece, wherein the top piece includes the outer threads and receiving structure.

Alternatively or additionally to any of the examples above, in another example, engagement of the inner threads of the outer cap with the outer threads of the inner cap may seal the second end of the tubular sleeve.

Alternatively or additionally to any of the examples above, in another example, the stem may include a second applicator.

Alternatively or additionally to any of the examples above, in another example, the cosmetic container may include a wiper which may be adapted for placement within the inner cap, and the stem may be configured to pass therethrough.

Alternatively or additionally to any of the examples above, in another example, disengagement of the inner threads of the outer cap with the outer threads of the inner cap may allow access to the second end of the tubular sleeve.

Alternatively or additionally to any of the examples above, in another example, the cosmetic container of claim may include a top cap, and the top cap may include inner threads which may be configured to engage with the outer threads of the outer side of the at least one upper sidewall.

Another illustrative, non-limiting example takes the form of a cosmetic container, comprising: a tubular sleeve defining a cavity and having a first end with a first opening and a second end with a second opening; a combined sidewall and dispenser structure attached to the first end of the tube, the sidewall having an inner side and an outer side and a receiving structure, the outer side including outer threads, the inner side attached to the sleeve, the dispenser having a passageway extending to at least a portion of an interior of the tubular sleeve; a cap assembly having an inner cap and an outer cap, the inner cap attached to the second end of the tubular sleeve, the inner cap having outer threads on an outer side of the inner cap; wherein the outer cap has a bottom and an outer wall, the outer wall having inner threads configured to engage with the inner threads of the outer side of the inner cap; and wherein the second opening allows access to the cavity of the tubular sleeve.

Alternatively or additionally, the tubular sleeve is an extruded tube having a thickness of about 0.1 to about 2 mm; the upper sidewall and dispenser structure is insert molded onto the first end of the tubular sleeve as a single piece; and the inner cap is insert molded onto second end of the tubular sleeve.

Alternatively or additionally the tubular sleeve is an extruded tube having a thickness of about 0.1 to about 2 mm; the upper sidewall and dispenser structure is insert molded onto the first end of the tubular sleeve as a single piece; and the inner cap is separately formed and then attached to the tubular sleeve using at least one of mechanical force, adhesive, or welding.

Alternatively or additionally the tubular sleeve is an extruded tube having a thickness of about 0.1 to about 2 mm; the inner cap is insert molded onto the second end of the tubular sleeve; and the upper sidewall and dispenser structure is separately formed and then attached to the tubular sleeve by at least one of mechanical force, adhesive, or welding.

Alternatively or additionally the dispenser comprises an exterior having at least one tab, slot or indentation for securing to an applicator adapted for securing to the dispenser using the at least one tab, slot or indentation, and the cosmetic container further comprises the applicator. Alternatively or additionally the applicator comprises a metal or ceramic applicator.

Alternatively or additionally the outer cap further comprises a stem having a second applicator thereon, the container further comprising a wiper adapted for placement within the inner cap, wherein the stem and second applicator are configured to pass through the wiper.

Alternatively or additionally to any of the examples above, in another example, engagement of the inner threads of the top cap with the outer threads of the outer side of the at least one upper sidewall may close the first end of the tubular sleeve. Alternatively or additionally to any of the examples above, in another example, the top cap may include a pintel which may be configured to engage with the aperture of the first applicator to seal the aperture when the inner threads of the top cap engage with the outer threads of the outer side of the at least one upper sidewall.

Another illustrative and non-limiting example takes the form of a method of manufacturing a cosmetic container comprising: starting with an extruded tube having a first end and a second end, attaching a first end structure to the first end of the extruded tube, the first end structure comprising a securing structure to attach to an upper cap and a dispenser having a passageway therethrough to dispense product from inside the extruded tube; and attaching an inner cap on the second end of the extruded tube.

Additionally or alternatively to the method example, the step of attaching the inner cap comprises insert molding the inner cap by passing a mandrel through the second end of the extruded tube and into the extruded tube to support the tube during insert molding of the inner cap.

Additionally or alternatively to the method example, the inner cap is a separately formed piece, and the step of attaching the inner cap on the second end of the extruded tube comprises at least one of welding, applying adhesive, or mechanical fixation.

Additionally or alternatively to the method example, the step of attaching the first end structure comprises insert molding the first end structure on the first end of the extruded tube, wherein: to insert mold the first end structure, a mandrel is placed through the second end of the extruded tube before the inner cap is placed, and a collapsible mandrel or a multi-part mandrel is placed through the second end of the tube and the tube is crimped onto the collapsible or multi-part mandrel for insert molding the inner cap to thereby attach the inner cap to the extruded tube.

Additionally or alternatively to the method example, the step of attaching the first end structure comprises insert molding the first end structure on the first end of the extruded tube, wherein: the inner cap is insert molded onto the second end of the extruded tube, thereby attaching the inner cap to the extruded tube, by advancing a mandrel through the first end of the extruded tube before the first end structure is attached; and to insert mold the first end structure, a collapsible or multi-part mandrel is placed through the inner cap and second end of the extruded tube after the inner cap is placed and the tube is crimped onto the collapsible or multipart mandrel for insert molding the first end structure.

Additionally or alternatively to the method example, the dispenser comprises an exterior having at least one tab, slot or indentation for securing to an applicator adapted for securing to the dispenser using the at least one tab, slot or indentation, the method further comprising securing the applicator onto the receiver.

The above summary of some example embodiments is not intended to describe each disclosed embodiment or every implementation of the present disclosure. The Figures, and Detailed Description, which follow, more particularly exemplify these embodiments.

BRIEF DESCRIPTION OF THE DRAWINGS

The foregoing and other aspects of the present invention are best understood from the following detailed description when read in connection with the accompanying drawings. For the purpose of illustrating the invention, there is shown in the drawings, embodiments that are presently preferred, it being understood, however, that the invention is not limited to the specific instrumentalities disclosed. Included in the drawings are the following Figures.

DETAILED DESCRIPTION

Figure 1:
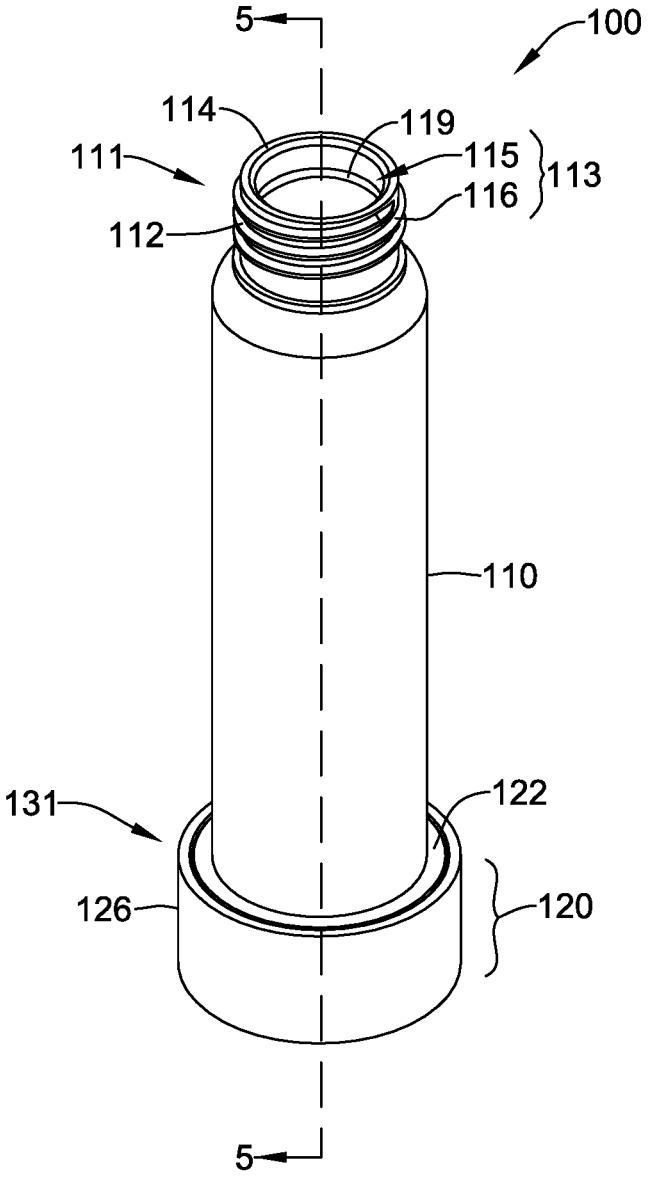
FIG. 1 is a top perspective view of an illustrative cosmetic container.

The following description should be read with reference to the drawings wherein like reference numerals indicate like elements throughout the several views. The description and drawings show several embodiments which are meant to be illustrative in nature.

For convenience, the present disclosure may be described using relative terms including, for example, left, right, top, bottom, front, back, upper, lower, up, and down, as well as others. It is to be understood that these terms are merely used for illustrative purposes and are not meant to be limiting in any manner.

FIG. 1 illustrates a top perspective view of an illustrative cosmetic container 100. As shown in FIG. 1, the cosmetic container 100 may include a tubular sleeve 110, and a cap assembly 120. The sleeve 110 may define a cavity 119, and may include a first end 111 and a second end 131. The first end 111 may include a first opening 114 which may be defined by at least one upper sidewall 113. The upper sidewall 113 may include an inner side 115 and an outer side 116, and the outer side 116 may include outer threads 112. In some embodiments, the first opening 114 defined by the at least one upper sidewall 113 may be configured to engage with a nozzle, a cap, a brush, a sponge, an applicator, or the like, as shown in FIGS. 17-20, but this is not necessary. Rather than outer threads 112, a circumferential set of tabs or a ring may be provided to allow for snap-on or twist on attachment of an applicator and/or sealing cap (not shown).

Figure 2:
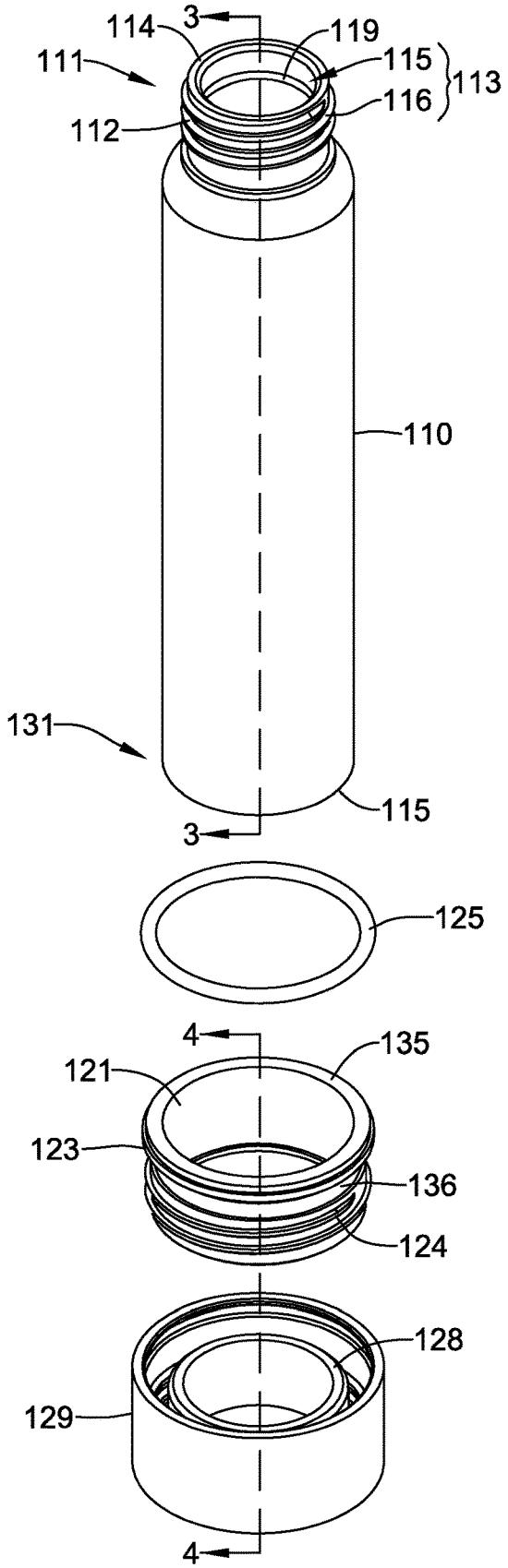
FIG. 2 is an exploded view of the illustrative cosmetic container of FIG. 1.

The sleeve 110 may further include a second opening 134 at the second end 131 of the sleeve 110, as shown in FIG. 2. The cap assembly 120 may include a cap ring 122 and a cap 126. The cosmetic container 100 may include the tubular sleeve 110 having a cylindrical shape and the cap assembly 120 having a circular shape, as shown in FIGS. 1-5B. Alternatively, the cosmetic container 100 may have a shape that is square, rectangular, triangular, oval, or any other desired shape.

FIG. 2 illustrates an exploded view of the illustrative cosmetic container 100. As shown in FIG. 2, the cosmetic container 100 may include the sleeve 110 defining the cavity 119 for receiving a cosmetic product such as, liquids, creams, gels, and various makeup or skincare products such as foundation, concealer, lotion serum, petroleum products, sunscreen, moisturizer, etc. The cosmetic container 100 may further include the cap assembly 120 which may include the cap ring 122 and the cap 126. The cap ring 122 may include an inner side 121 and an outer side 123. The outer side 123 of the cap ring 122 may further include an annular ridge 135, outer threads 124 for coupling the cap ring 122 to the cap 126, and a channel 136 positioned between the annular ridge 135 and the outer threads 124. The cap ring 122 may be adapted for placement and/or attachment at or adjacent the second end 131 of the sleeve 110 (as shown further in FIGS. 5A-5C). The cap ring 122 may be attached to the sleeve 110 via friction fit, and/or may be attached or further secured using heat, laser, or sonic welding, injection molding, adhesive, or any other suitable method of attachment.

The cap 126 may include a bottom 127, an optional inner wall 128, and an outer wall 129. The outer wall 129 may include inner threads 130. The inner threads 130 may be configured to engage with the outer threads 124 of the cap ring 122 for coupling the cap 126 to the cap ring 122 so as to seal a second opening 134 of the second end 131 of the sleeve 110. Alternatively, the cap 126 may not include inner threads 130 and the cap ring 122 may not include outer threads 124, and instead snap fit or interference fit may be used in place of the threaded coupling.

Figure 4:
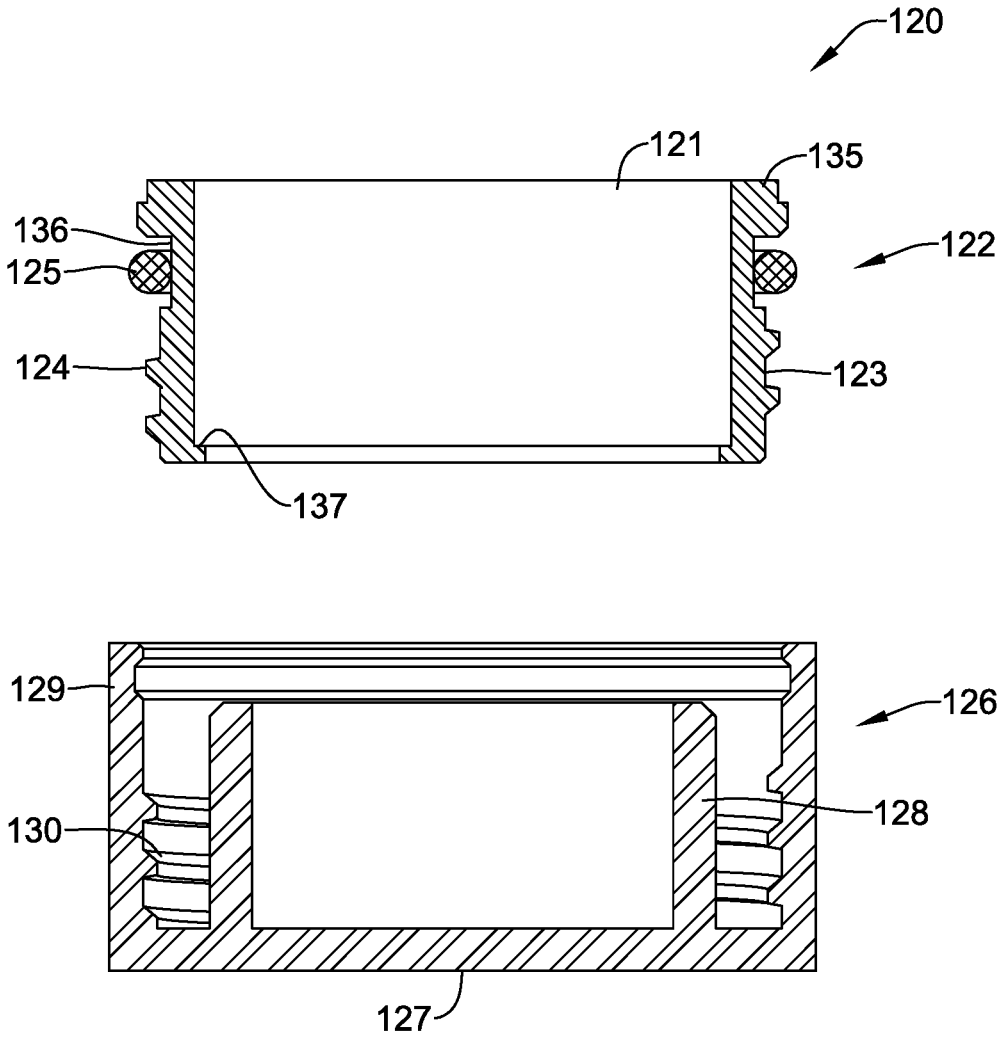
FIG. 4 is a cross-section view of an illustrative cap assembly as in FIG. 2, taken at lines 4-4.
Figure 5A:
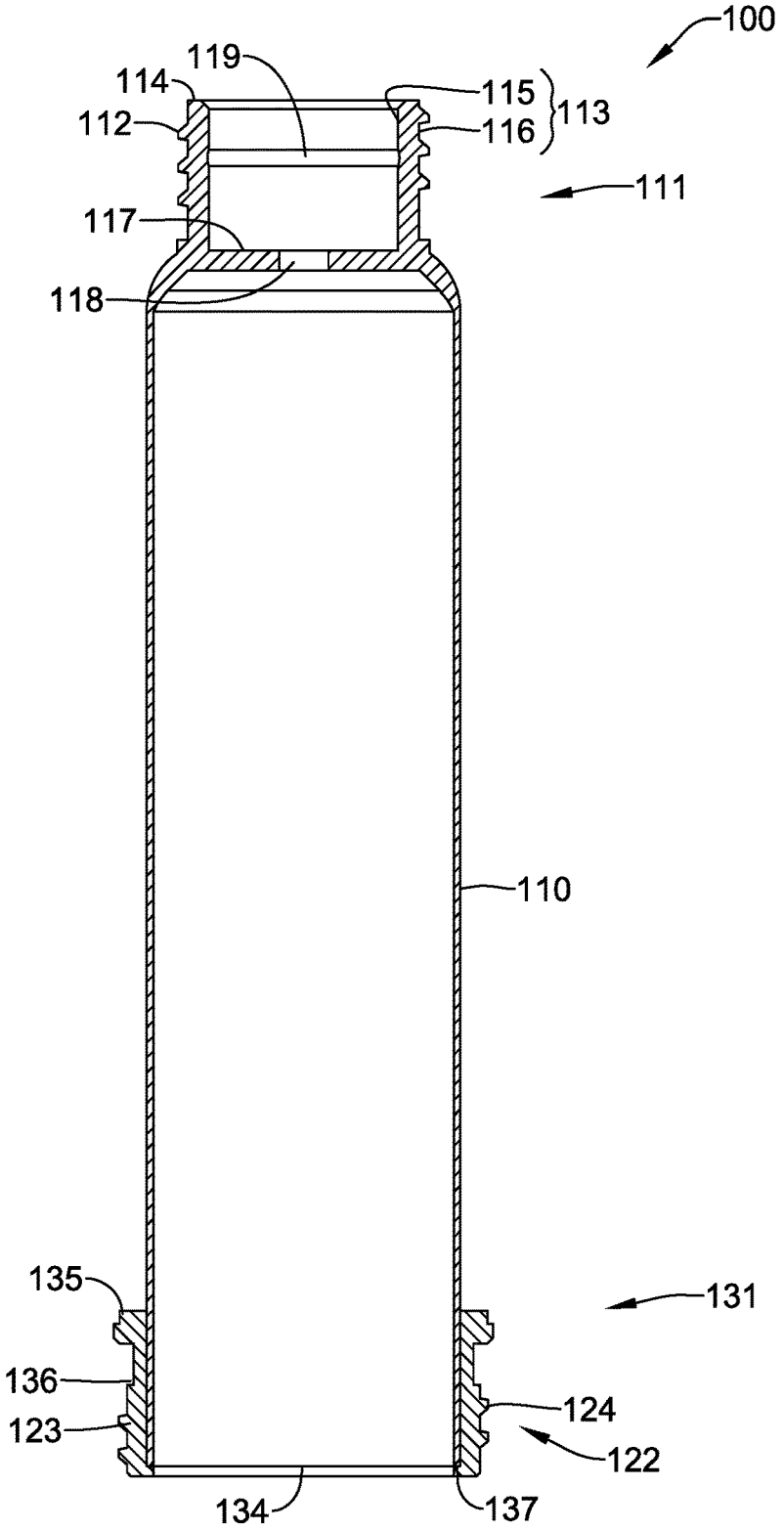
FIG. 5A is a cross-section view of the illustrative cosmetic container as in FIG. 1, taken at lines 5-5, with the cap and O-ring removed.
Figure 5B:
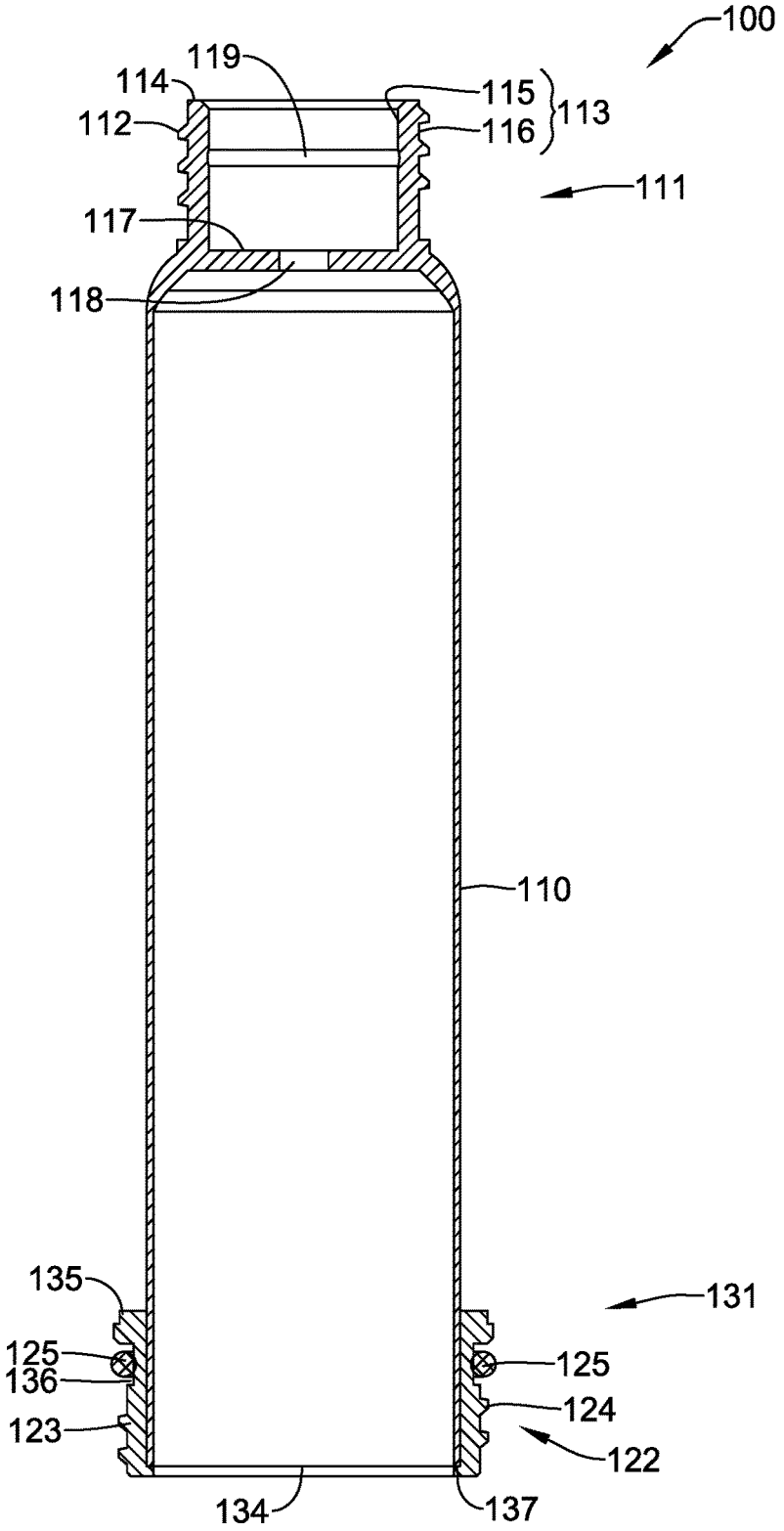
FIG. 5B is a cross-section view of the illustrative cosmetic container as in FIG. 1, taken at lines 5-5, with the cap removed.
Figure 5C:
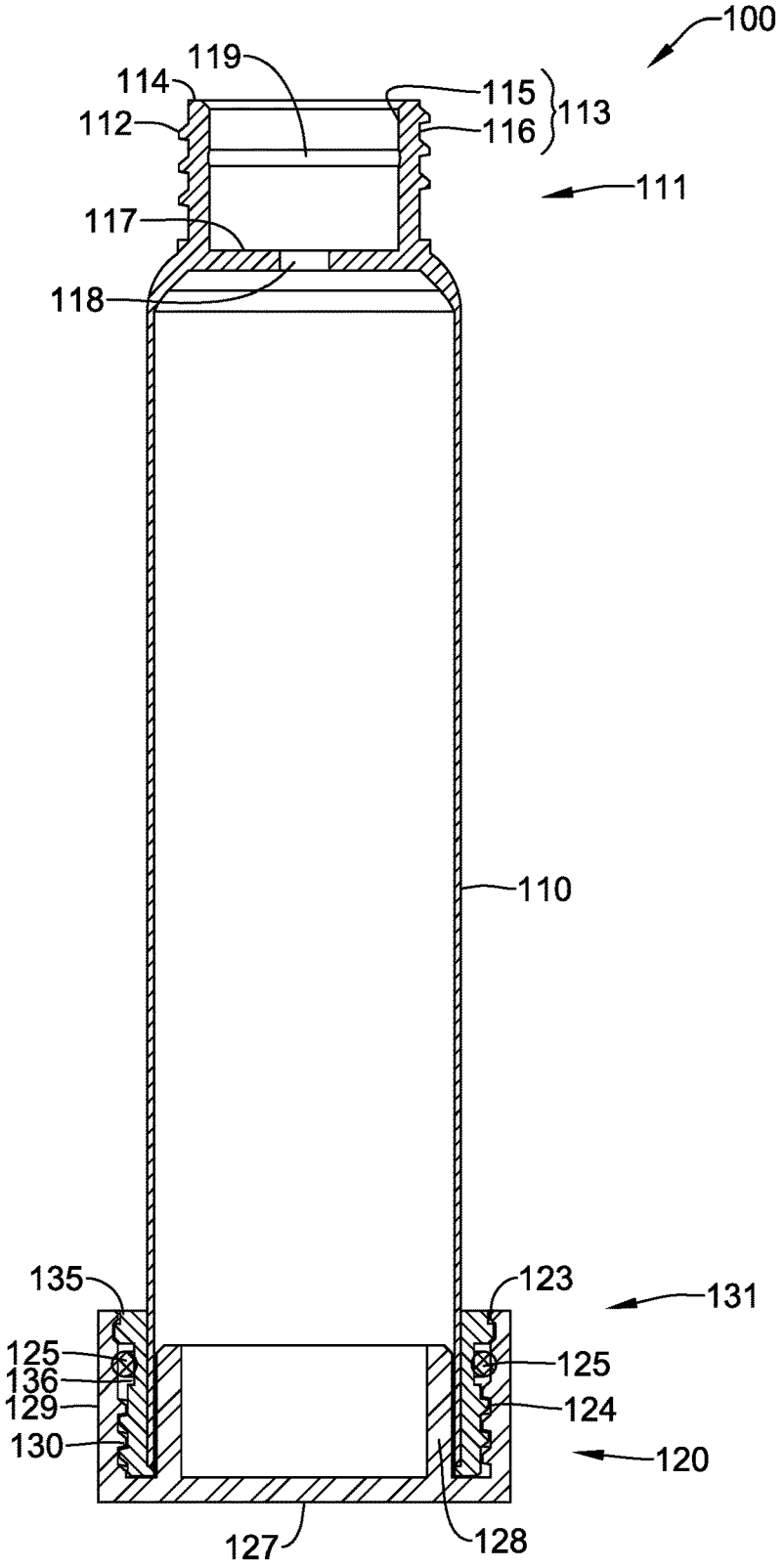
FIG. 5C is a cross-section view of the illustrative cosmetic container as in FIG. 1, taken at lines 5-5.

The cap ring 122 and the cap 126 assemblies may have a substantially round (e.g., cylindrical) shape in which the seal may be provided by a thread fastening mechanism, as shown in FIGS. 2, 4 and 5C. However, it is contemplated that the cap ring 122 and the cap 126 may have an alternative shape (e.g., square, rectangular, oval, triangular, or any other shape desired) and may be sealed by a magnetic fastening mechanism, a snap fastening mechanism (e.g., a snap fit) or a clamp fastening system. It may be further contemplated that the cap ring 122 and the cap 126 have one shape, such as a square, and inner pieces have a second, substantially round shape, wherein closure may be provided by a thread, snap, or other suitable fastening mechanism.

The cap assembly 120 may include an O-ring 125, which may be configured to fit around the outer side 123 of the cap ring 122 in the channel 136 positioned between the annular ridge 135 and the outer threads 124. The O-ring 125 may have a thickness that is greater than a width between the outer wall 129 of the cap 126 and the channel 136 of the cap ring 122. In this manner, when fastened together (e.g., placement of the cap 126 over the cap ring 122), the cap assembly 120 can compress the O-ring 125 interposed by the cap ring 122 and the cap 126, thereby creating a seal.

Figure 3:
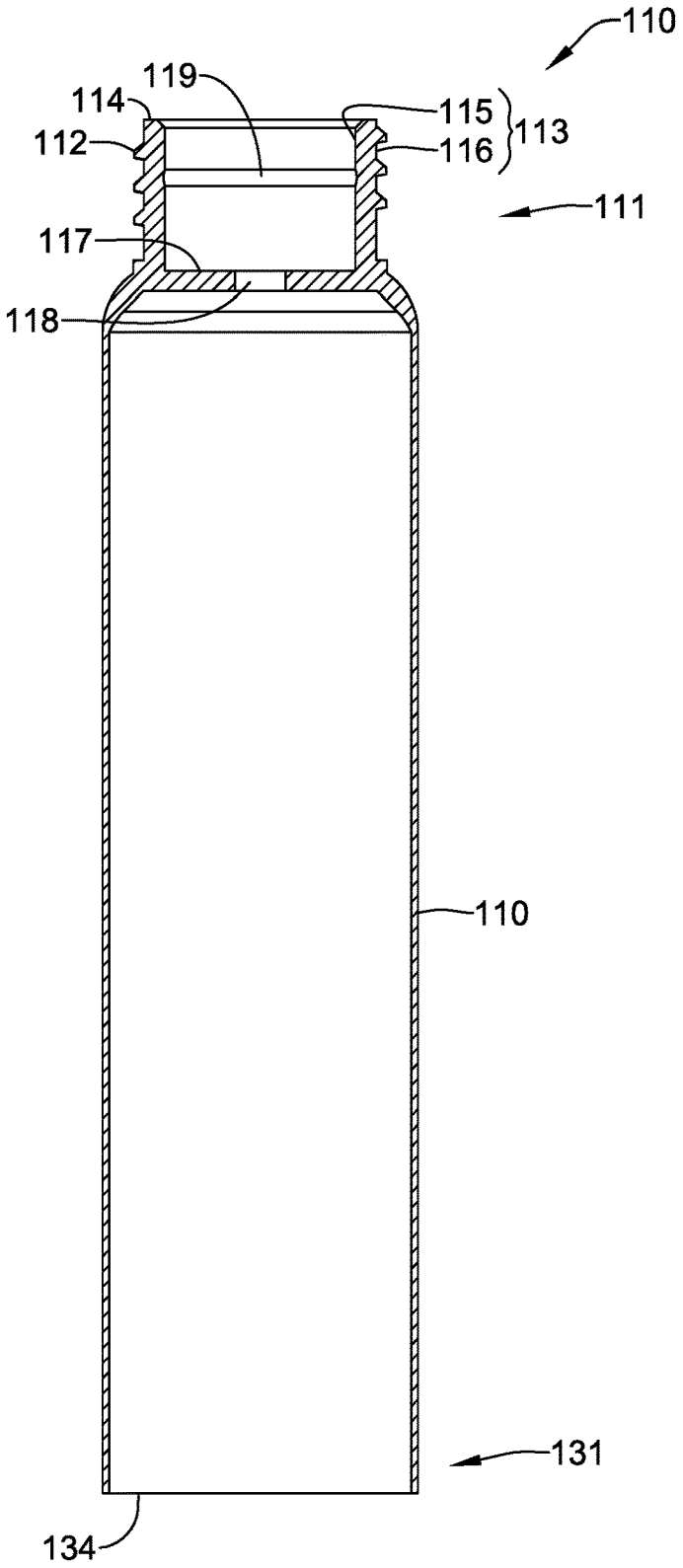
FIG. 3 is a cross-section view of an illustrative tubular sleeve as in FIG. 2, taken at lines 3-3.

FIG. 3 illustrates a cross-section view of the illustrative tubular sleeve 110 as in FIG. 2, taken at lines 3-3. As discussed with reference to FIGS. 1 and 2, the sleeve 110 may define the cavity 119 for receiving a cosmetic product. The sleeve 110 may include the first end 111 which may include the first opening 114 defined by the at least one upper sidewall 113. The upper sidewall 113 may include the inner side 115 and the outer side 116, and the outer side 116 may include the outer threads 112. The first end 111 may be formed by injection molding the first end 111 onto the sleeve 110. The sleeve 110 may further include the second end 131 which may include the second opening 134. The second opening 134 may allow access to the cavity 119 within the sleeve 110, thereby allowing the cavity 119 of the sleeve 110 to be filled with a cosmetic product. In some embodiments, the second opening 134 may have a cylindrical shape, as illustrated in FIGS. 1-5C, which may be configured to engage with the cap assembly 120, as shown further in FIGS. 5A-5C. It is contemplated that the second opening 134 may have any other suitable shape (e.g., conical, frustoconical, cylindrical, oval, or the like).

As shown in FIG. 3, the first end 111 of the sleeve 110 may include a lower end 117 and an opening 118 within the lower end 117. The lower end 117 may provide a barrier between a cosmetic product contained within the sleeve 110 and the first opening 114 of the sleeve 110. The opening 118 may be provided in the lower end 117 to allow access to the cosmetic product after the sleeve 110 has been sealed. The lower end 117 and the opening 118 together may prevent unintentional spillage of the cosmetic product and/or may prevent a user from acquiring more cosmetic product than intended. In some embodiments, the opening 118 may be a hole provided at a center of the lower end 117, as illustrated in FIG. 3. In other embodiments, the opening 118 may include two or more holes. In some embodiments, the lower end 117 and the opening 118 may not be included. These are just some examples.

FIG. 4 illustrates a cross-section view of the illustrative cap assembly 120 as in FIG. 2, taken at lines 4-4. As discussed with reference to FIGS. 1 and 2, the cap assembly 120 may include the cap ring 122 and the cap 126. The cap ring 122 may include the inner side 121 and the outer side 123. The outer side 123 of the cap ring 122 may further include the annular ridge 135 and the outer threads 124 for coupling the cap ring 122 to the cap 126. The cap ring may further include the channel 136 positioned between the annular ridge 135 and the outer threads 124. The channel 136 may be provided to receive the O-ring 125. The cap ring 122 may be adapted for placement at or around the second end 131 of the sleeve 110 (as shown further in FIGS. 5A-5C). The cap ring 122 may be attached to the sleeve 110 via heat-welding, injection molding, adhesion, or any other suitable method of attachment.

The cap 126 may include the bottom 127, the inner wall 128, and the outer wall 129. The outer wall 129 may include the inner threads 130. The inner threads 130 may be configured to engage with the outer threads 124 of the cap ring 122 for coupling the cap 126 to the cap ring 122 so as to seal the second opening 134 of the second end 131 of the sleeve 110. Alternatively, the cap 126 may not include inner threads 130 and the cap ring 122 may not include outer threads 124, and instead snap fit or interference fit may be used in place of the threaded coupling. In some examples the inner wall 128 may be omitted, as an adequate seal may be had by attachment of the cap ring 122 to the tubular sleeve and subsequent attachment of the cap 126 to the cap ring, with or without the aid of the O-ring 125.

The cap ring 122 and the cap 126 assemblies (e.g., cap assembly 120) may have a substantially round (e.g., cylindrical) shape in which the seal may be provided by a thread fastening mechanism, as shown in FIGS. 2, 4 and 5C. However, it is contemplated that the cap ring 122 and the cap 126 may have an alternative shape (e.g., square, rectangular, oval, triangular, or any other shape desired) and may be sealed by a magnetic fastening mechanism, a snap fastening mechanism (e.g., a snap fit) or a clamp fastening system. It may be further contemplated that the cap ring 122 and the cap 126 have one shape, such as a square, and inner pieces have a second, substantially round shape, wherein closure may be provided by a thread fastening mechanism.

FIGS. 5A-5C illustrate cross-section views of the illustrative cosmetic container 100 as in FIG. 1, taken at lines 5-5. FIG. 5A shows the cosmetic container 100 with the cap 126 and the O-ring 125 removed. As shown, the cap ring 122 may be adapted for placement at or around the second end 131 of the sleeve 110. The cap ring 122 may include a lip 137 located on the inner side 121 of the cap ring. The lip 137 may interact with the second opening 134 of the sleeve 110 and serve as a stop for the cap ring 122. In this manner, when the cap ring 122 is placed over the second end 131 of the sleeve 110, the lip 137 abuts the second end 131 of the sleeve 110 thereby preventing further advancement of the cap ring 122 over the sleeve 110. The cap ring 122 may then be secured to the sleeve 110 via heat-welding, injection molding, adhesion, or any other suitable method of attachment. The O-ring 125 (when included) may then be placed around the cap ring 122 in the channel 136, as shown in FIG. 5B.

As shown in FIG. 5C, the cap 126 may be coupled to the cap ring 122. The inner threads 130 of the cap 126 engage with the outer threads 124 of the cap ring 122 such that the cap 126 may be threaded on to the cap ring 122. The inner wall 128 of the cap 126 is optional. When included, the inner wall 128 may be adapted for placement within the second opening 134 of the sleeve 110. The inner wall 128 of the cap 126 may be utilized as an alignment when placing the cap 126 over the cap ring 122.

The outer wall 129 of the cap 126 may be adapted for placement around the cap ring 122. The inner wall 128 and the outer wall 129 may be connected via the bottom 127 of the cap 126. When the cap 126 is threaded on to the cap ring 122, the bottom 127 effectively closes the second opening 134 of the sleeve 110. When the O-ring 125 is included, the O-ring 125, which may have a thickness that is greater than the width between the outer wall 129 of the cap 126 and the channel 136 of the cap ring 122, may be compressed between the outer side 123 of the cap ring 122 and the outer wall 129 of the cap 126, thereby creating a seal.

Figure 6:
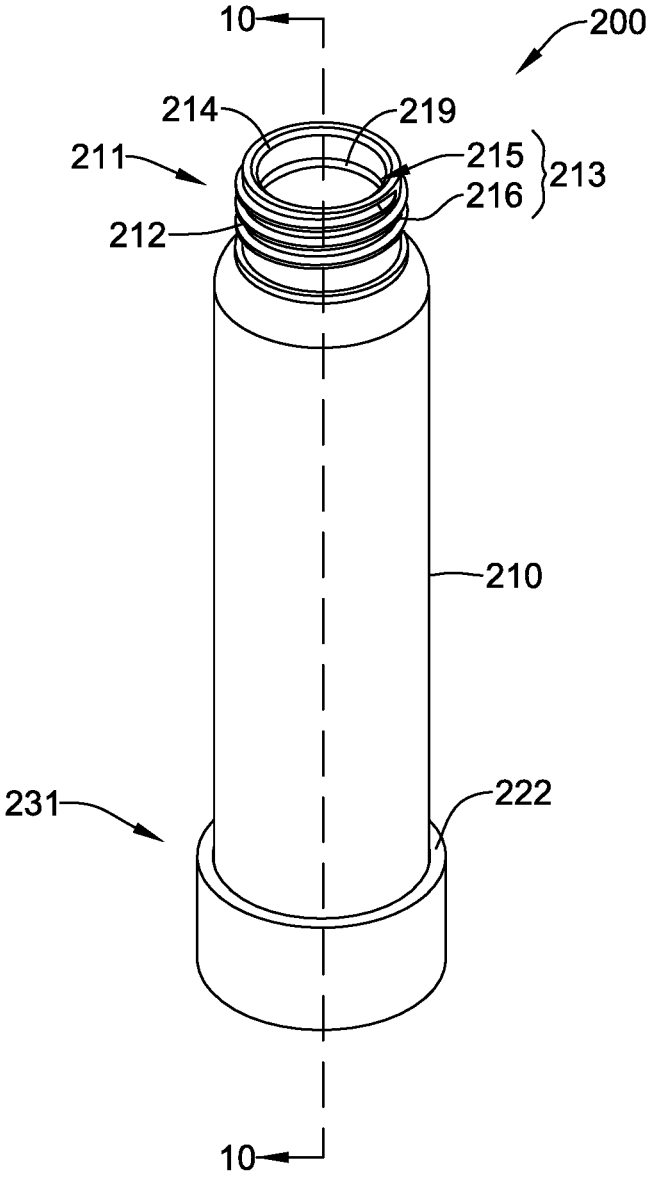
FIG. 6 is a perspective view of an illustrative cosmetic container.
Figure 7:
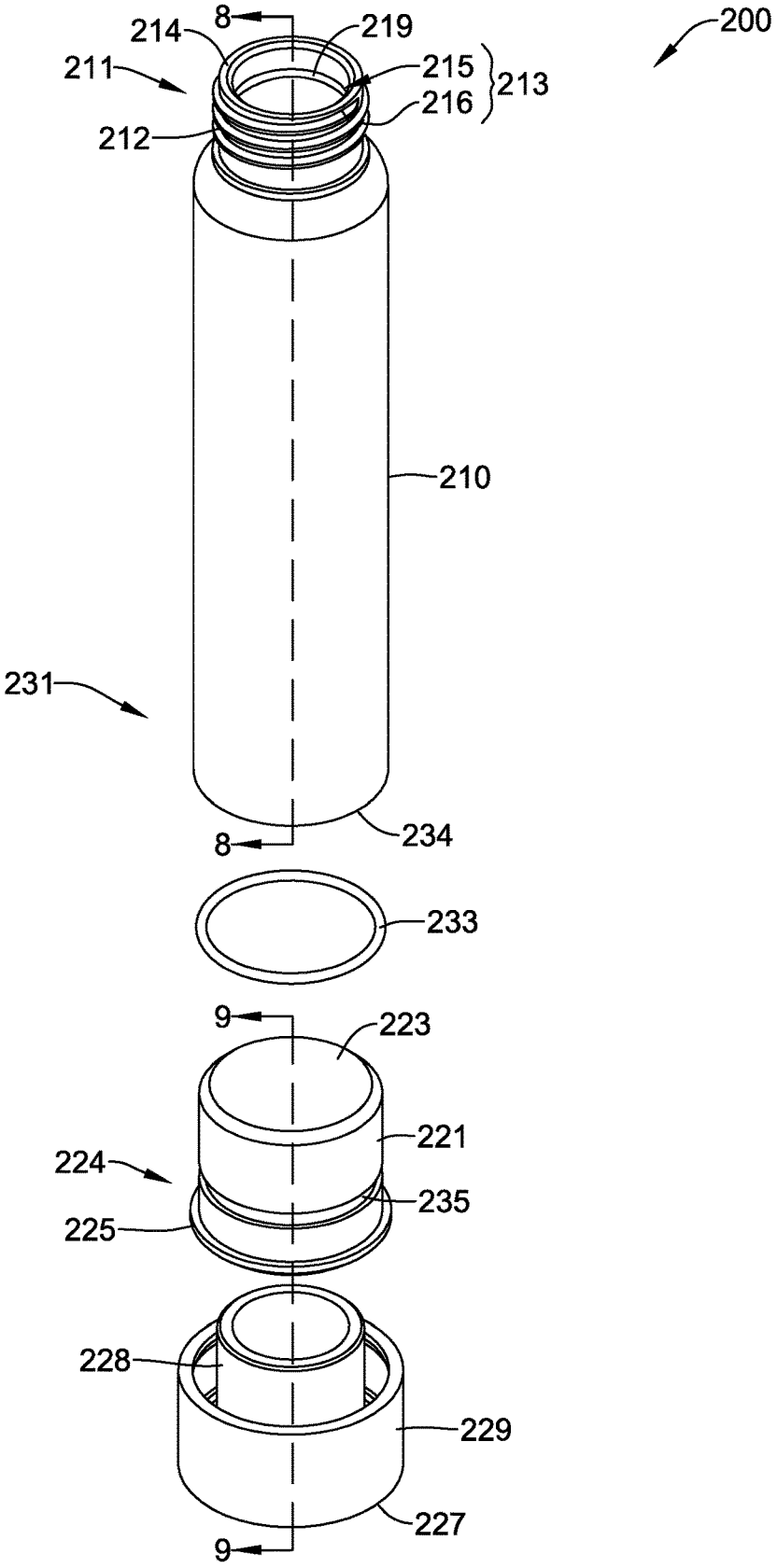
FIG. 7 is an exploded view of the illustrative cosmetic container of FIG. 6.

FIG. 6 illustrates a perspective view of an illustrative cosmetic container 200. As shown in FIG. 6, the cosmetic container 200 may include a tubular sleeve 210, and a cap assembly 220. The sleeve 210 may define a cavity 219, and may include a first end 211 and a second end 231. The first end 211 may include a first opening 214 which may be defined by at least one upper sidewall 213. The sleeve 210 may further include a second opening 234 at the second end 231 of the sleeve 210, as shown in FIG. 7. The upper sidewall 213 may include an inner side 215 and an outer side 216, and the outer side 216 may include outer threads 212. Again, other connective structures aside from outer threads 212 may be used.

In some embodiments, the first opening 214 defined by the at least one upper sidewall 213 may be configured to engage with a nozzle, a cap, a brush, a sponge, an applicator, or the like, but this is not necessary. The cap assembly 220 may include an inner plug 222 and an outer cap 226. The cosmetic container 200 may include the tubular sleeve 210 having a cylindrical shape and the cap assembly 220 having a circular shape, as shown in FIGS. 6-10B. Alternatively, the cosmetic container 200 may have a shape that is circular, square, rectangular, triangular, oval, or any other desired shape.

FIG. 7 illustrates an exploded view of the illustrative cosmetic container 200. As shown in FIG. 7, the cosmetic container 200 may include the sleeve 210 defining the cavity 219 for receiving a cosmetic product such as, liquids, creams, gels, and various makeup products such as foundation, concealer, lotion serum, petroleum products, sunscreen, etc. The cosmetic container 200 may further include the cap assembly 220 which may include the inner plug 222 and the outer cap 226. The inner plug 222 may include sidewalls 221, an upper end 223, and a lower end 224. The lower end 224 may further include an outer ridge 225, and the sidewalls 221 may include a groove 235. The upper end 223 of the inner plug 222 may be a closed end, as illustrated in FIG. 7. The inner plug 222 may be adapted for placement within the second opening 234 of the sleeve 210. The outer ridge 225 may serve as a stop for the inner plug 222, as discussed further in reference to FIG. 10A.

The outer cap 226 may include a bottom 227, an optional inner wall 228, and an outer wall 229. If included, the inner wall 228 of the outer cap 226 may be positioned within the inner plug 222. The outer wall 229 of the outer cap 226 may be configured to be positioned around the second end 231 of the sleeve 210, as will be discussed further with reference to FIGS. 9 and 10B.

Figure 10A:
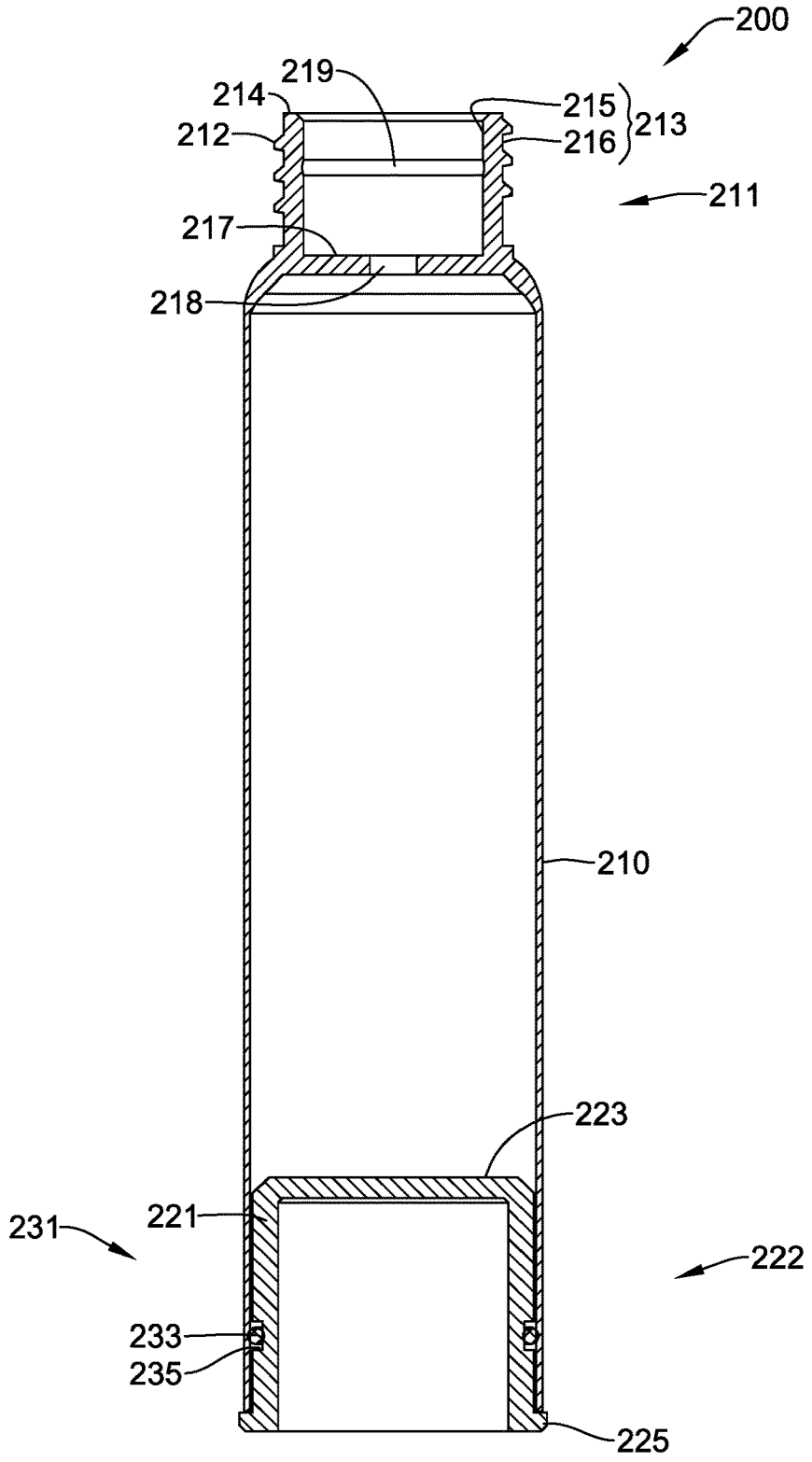
FIG. 10A is a cross-section view of the illustrative cosmetic container as in FIG. 6, taken at lines 10-10, with the cap removed.
Figure 10B:
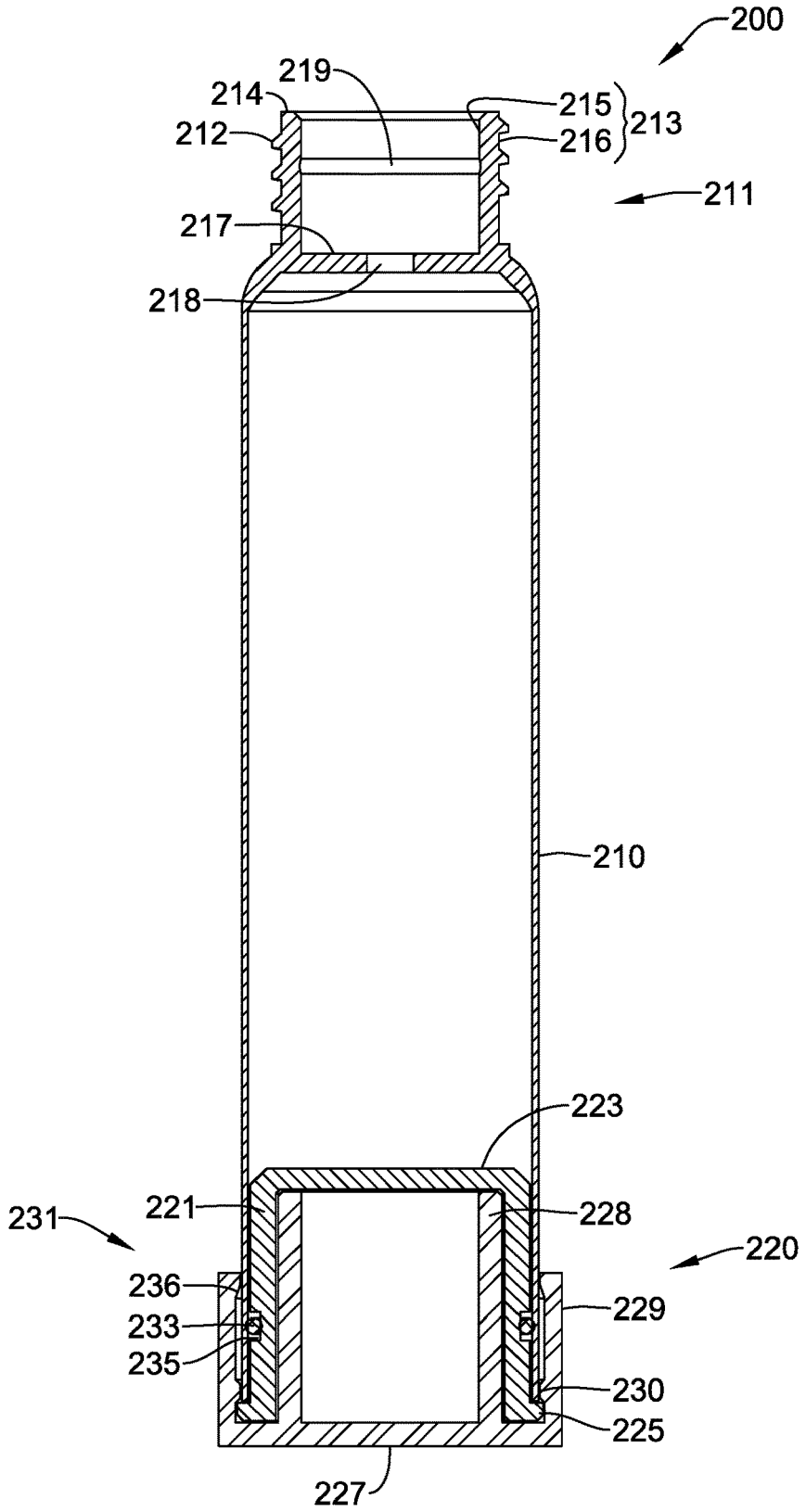
FIG. 10B is a cross-section view of the illustrative cosmetic container as in FIG. 6, taken at lines 10-10.

The inner plug 222 and the outer cap 226 assemblies (e.g., cap assembly 220) may have a substantially round (e.g., cylindrical) shape in which the seal may be provided by a friction fit, as shown in FIGS. 7, 10A and 10B. However, it is contemplated that the inner plug 222 and the outer cap 226 may have an alternative shape (e.g., square, rectangular, oval, triangular, or any other shape desired) and may be sealed by a magnetic fastening mechanism, a snap fastening mechanism (e.g., a snap fit) or a clamp fastening system. It may be further contemplated that the inner plug 222 and the outer cap 226 have one shape, such as a square, and inner pieces have a second, substantially round shape, wherein closure may be provided by a thread fastening mechanism.

The cap assembly 220 may include an O-ring 233, which may be configured to fit around the sidewalls 221 of the inner plug 222 in the groove 235 positioned within the sidewalls 221. The O-ring 233 may have a thickness that is greater than a width of inner plug 222, when placed in the groove 235. In this manner, when the inner plug 222 is placed within the second end 231 of the sleeve 210, the inner plug 222 and the sleeve 210 can compress the O-ring 233 interposed by the inner plug 222 and the sleeve 210 to achieve an airtight seal. Other examples may not include an O-ring and may not be airtight and may simply serve to effectively contain and prevent spillage of the cosmetic product therein.

Figure 8:
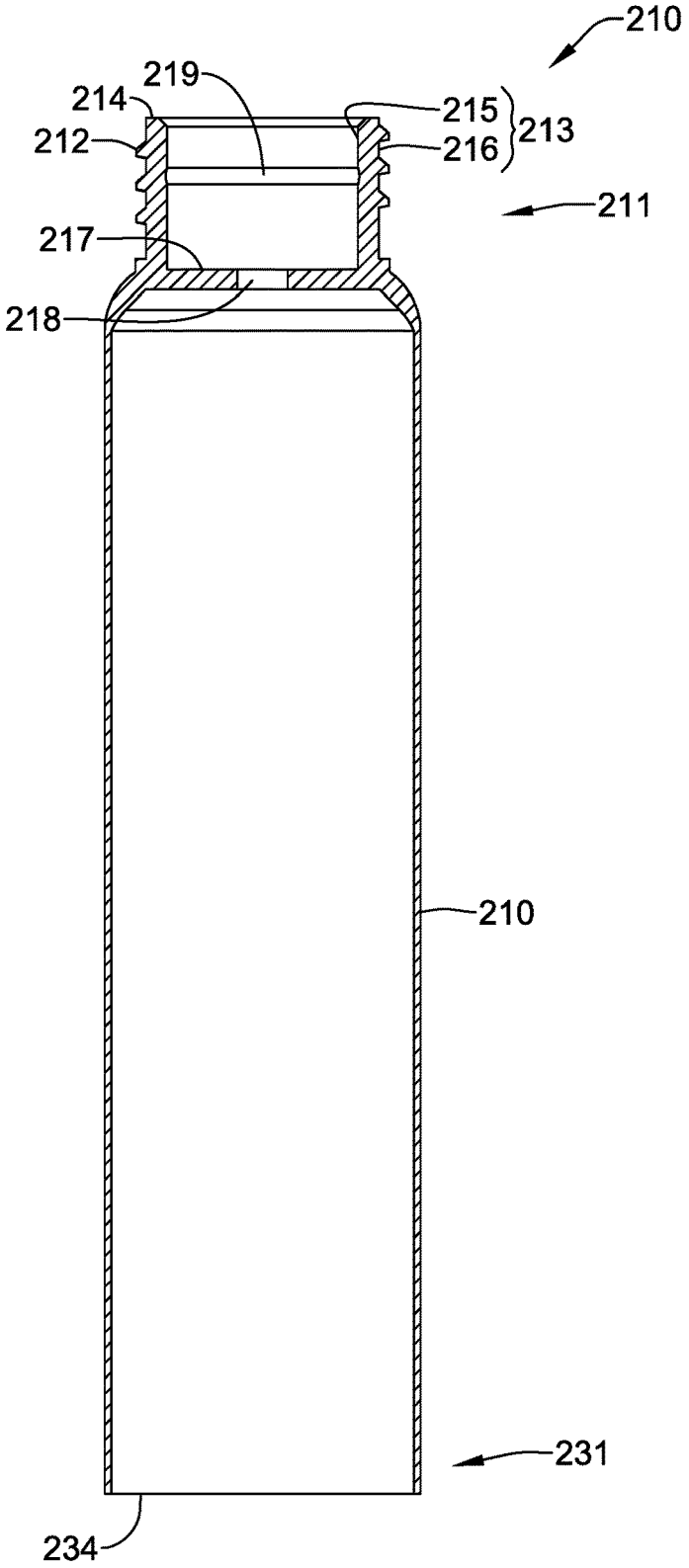
FIG. 8 is a cross-section view of an illustrative tubular sleeve as in FIG. 7, taken at lines 8-8.

FIG. 8 illustrates a cross-section view of the illustrative tubular sleeve 210 as in FIG. 7, taken at lines 8-8. As discussed with reference to FIGS. 6 and 7, the sleeve 210 may define the cavity 219 for receiving a cosmetic product. The sleeve 210 may include the first end 211 which may include the first opening 214 defined by the at least one upper sidewall 213. The upper sidewall 213 may include the inner side 215 and the outer side 216, and the outer side 216 may include the outer threads 212. The first end 211 may be formed by injection molding the first end 211 onto the sleeve 210. The sleeve 210 may further include the second end 231 which may include the second opening 234. The second opening 234 may allow access to the cavity 219 within the sleeve 210, thereby allowing the cavity 219 of the sleeve 210 to be filled with a cosmetic product. In some embodiments, the second opening 234 may have a cylindrical shape, as illustrated in FIGS. 6-10B, which may be configured to engage with the cap assembly 220, as shown further in FIGS. 10A-10B. It may be contemplated that the second opening 234 may have any other suitable shape (e.g., conical, frustoconical, cylindrical, oval, or the like).

As shown in FIG. 8, the first end 211 of the sleeve 210 may include a lower end 217 and an opening 218 within the lower end 217. The lower end 217 may provide a barrier between a cosmetic product contained within the sleeve 210 and the first opening 214 of the sleeve 210. The opening 218 may be provided in the lower end 217 to allow access to the cosmetic product after the sleeve 210 has been sealed. The lower end 217 and the opening 218 together may prevent unintentional spillage of the cosmetic product and/or may prevent a user from acquiring more cosmetic product than intended. In some embodiments, the opening 218 may be a hole provided at a center of the lower end 217, as illustrated in FIG. 8. In other embodiments, the opening 218 may include two or more holes. In some embodiments, the lower end 217 and the opening 218 may not be included. These are just some examples.

Figure 9:
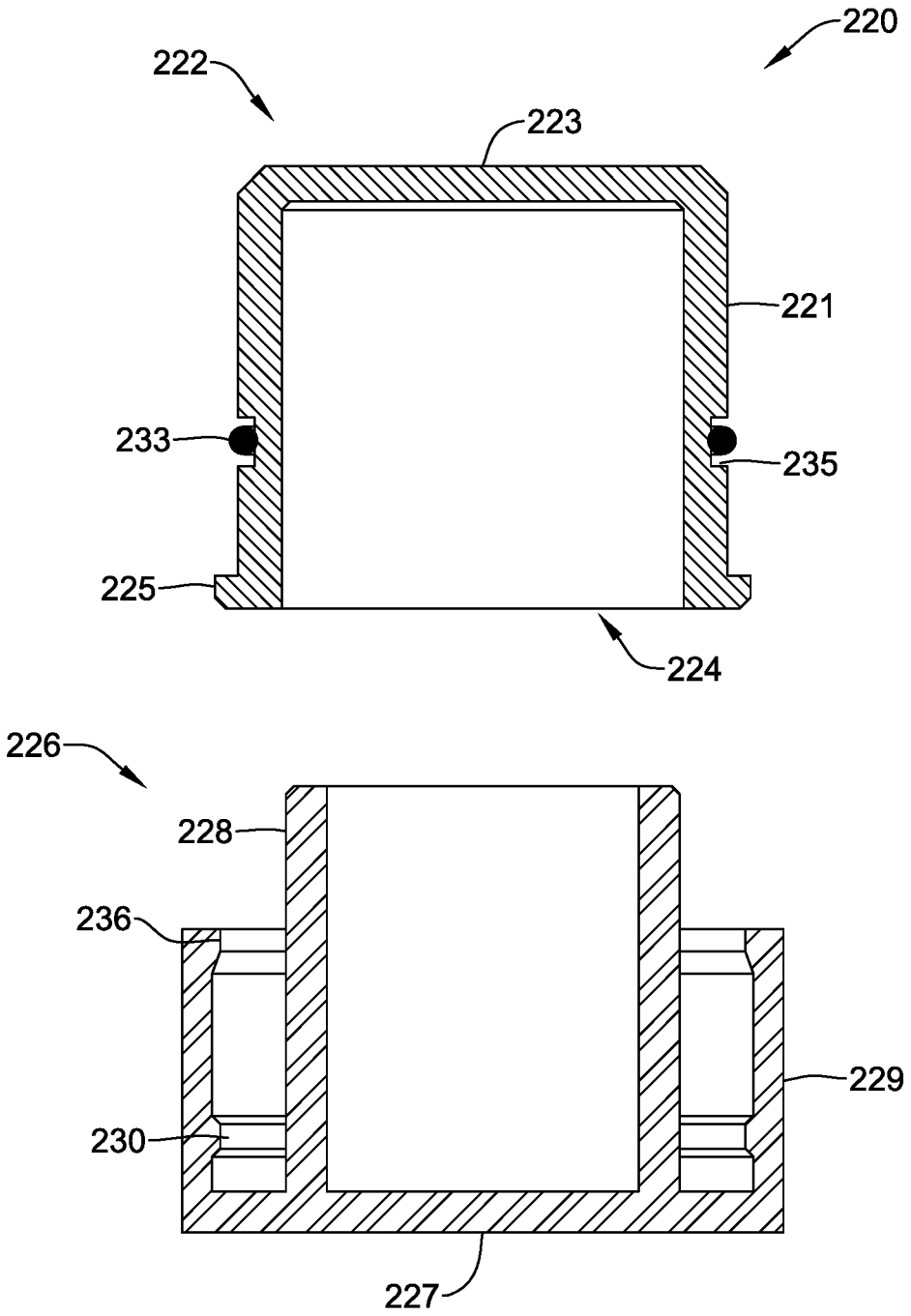
FIG. 9 is a cross-section view of an illustrative cap assembly as in FIG. 7, taken at lines 9-9.

FIG. 9 illustrates a cross-section view of the illustrative cap assembly 220 as in FIG. 7, taken at lines 9-9. As discussed with reference to FIGS. 6 and 7, the cap assembly 220 may include the inner plug 222 and the outer cap 226. The inner plug 222 may include the sidewalls 221, the upper end 223, and the lower end 224. The lower end 224 may further include the outer ridge 225, and the sidewalls 221 may include the groove 235. The O-ring 233 may be configured to fit around the sidewalls 221 of the inner plug 222 and fit within the groove 235. The upper end 223 of the inner plug 222 may be a closed end, as illustrated in FIG. 9. The inner plug 222 may be adapted for placement within the second opening 234 of the sleeve 210. The outer ridge 225 may serve as a stop for the inner plug 222, as discussed further with reference to FIGS. 10A and 10B.

The outer cap 226 may include the bottom 227, the optional inner wall 228, and the outer wall 229. The inner wall 228 of the outer cap 226 may be positioned within the inner plug 222, and the outer wall 229 of the outer cap 226 may be configured to be positioned around the second end 231 of the sleeve 210. The inner wall 228 of the outer cap 226 may be configured to fit within the inner plug 222 such that the inner wall 228 may abut the upper end 223 of the inner plug 222. The inner wall 228 may be utilized as an alignment when placing the outer cap 226 over the second end 231 of the sleeve 210. The outer wall 229 of the outer cap 226 may include a first inner ridge 230, which may be configured to engage with the outer ridge 225 of the inner plug 222, and a second inner ridge 236. The first inner ridge 230 may be positioned below the second inner ridge 236 along an inside of the outer wall 229. In some examples, the inner wall 228 is omitted, as sealing is provided by the inner plug 222 being secured to the sleeve 210, and the outer wall 229 being secured to the inner plug.

FIGS. 10A-10B illustrate cross-section views of the illustrative cosmetic container 200 as in FIG. 6, taken at lines 10-10. FIG. 10A shows the cosmetic container 200 with the outer cap 226 removed. As discussed above with reference to FIG. 9, the inner plug 222 may be adapted for placement within the second opening 234 of the sleeve 210. The O-ring 233 may be positioned within the groove 235 of the inner plug 222, and the inner plug 222 may include a shape and size such that when the inner plug 222 including the O-ring 233 is positioned within the second opening 234 of the sleeve 210, the inner plug 222 including the O-ring 233 may be held within the sleeve 210 via a friction fit.

The inner plug 222 may include the outer ridge 225 which may be configured to engage with the second opening 234 of the sleeve 210. The outer ridge 225 may serve to provide a stop for the inner plug 222, such that when the inner plug 222 is positioned within the second opening 234 of the sleeve 210, the outer ridge 225 abuts the second end 231 of the sleeve 210, thereby preventing further advancement of the inner plug 222 within the cavity 219 of the sleeve 210.

As shown in FIG. 10B, the outer cap 226 may be configured to engage with the inner plug 222, thereby sealing the second opening 234 of the sleeve 210. As discussed with reference to FIG. 9, the inner wall 228 of the outer cap 226 may be positioned within the inner plug 222, and the outer wall 229 of the outer cap 226 may be configured to be positioned around the second end 231 of the sleeve 210. The inner wall 228 of the outer cap 226 may be configured to fit within the inner plug 222 such that the inner wall 228 may abut the upper end 223 of the inner plug 222. The outer wall 229 of the outer cap 226 may include the first inner ridge 230, which may be configured to engage with the outer ridge 225 of the inner plug 222, and the second inner ridge 236. In some cases, the inner wall 228 of the outer cap 226 may be omitted.

The first inner ridge 230 may be positioned below the second inner ridge 236 along the inside of the outer wall 229, such that to place the outer cap 226 over the inner plug 222 and the sleeve 210, the second inner ridge 236 may first pass over the outer ridge 225 of the inner plug 222, via a force (e.g., push force). Using continued force, the first inner ridge 230 may then pass over the outer ridge 225. The first inner ridge 230 may engage with the outer ridge 225 of the inner plug 222 in a snap-fit fashion, thereby effectively sealing the second opening 234 of the sleeve 210. When the O-ring 233 is to included, the second inner ridge 236 may pass over the O-ring 233 before the first inner ridge 230 passes over the outer ridge 225 as the outer cap 226 is paced over the inner plug 222 and the second end 231 of the sleeve 210. In this manner, the outer cap 226 is snapped on and secures the cap assembly 220 to the sleeve 210 by adding pressure around the perimeter of the sleeve 210, thus providing a more secure "grip" between the inner plug 222, the sleeve 210 and the outer cap 226.

Figure 11:
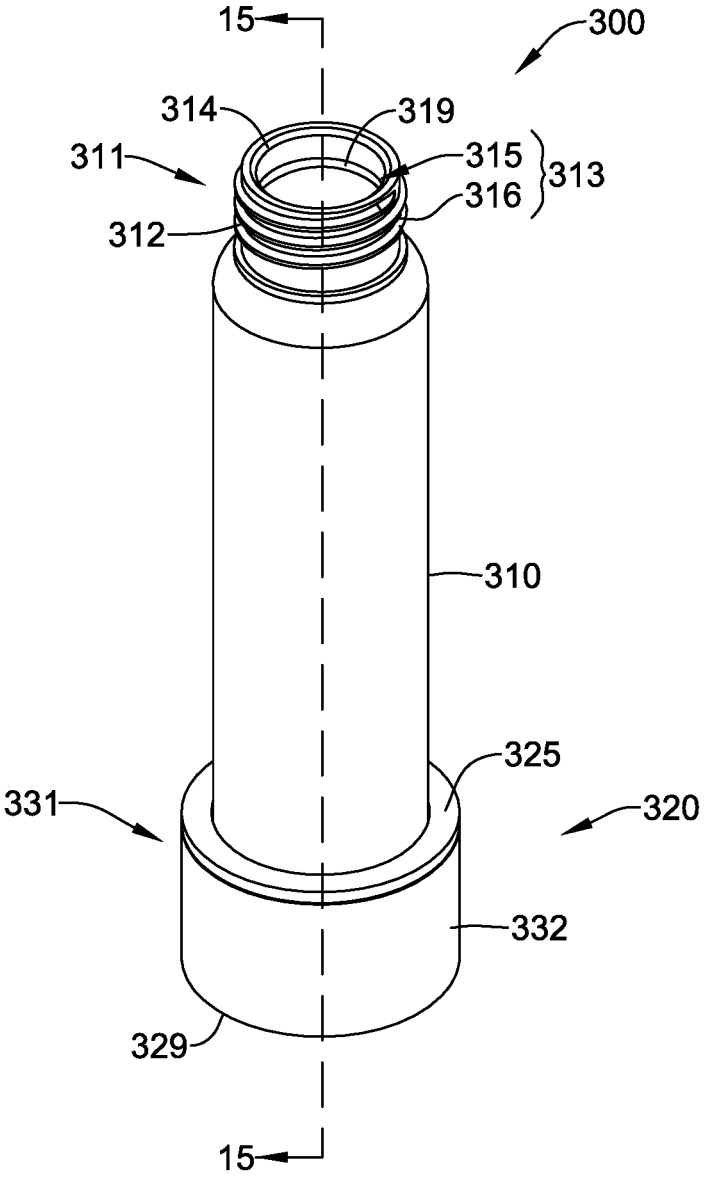
FIG. 11 is a perspective view of an illustrative cosmetic container.
Figure 12:
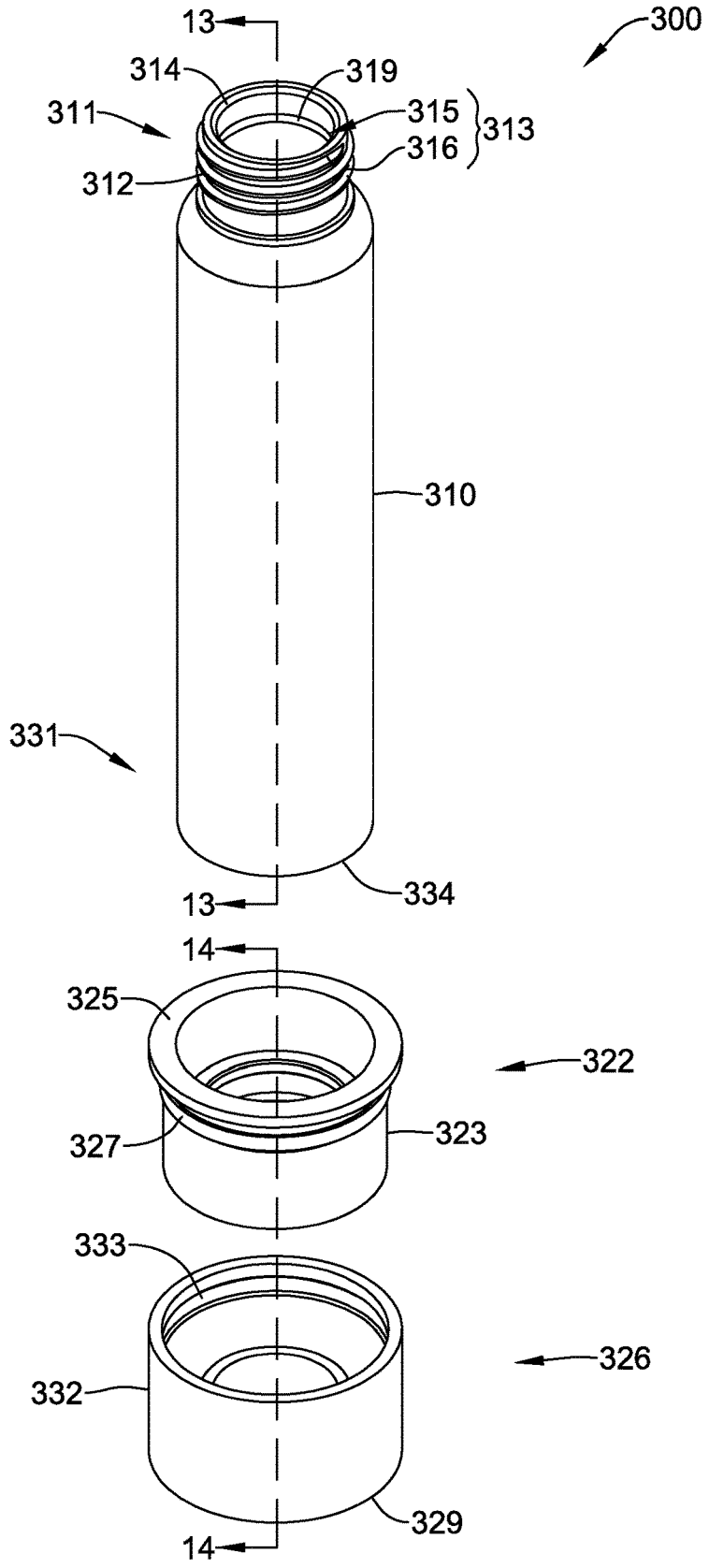
FIG. 12 is an exploded view of the illustrative cosmetic container of FIG. 11.
Figure 17:
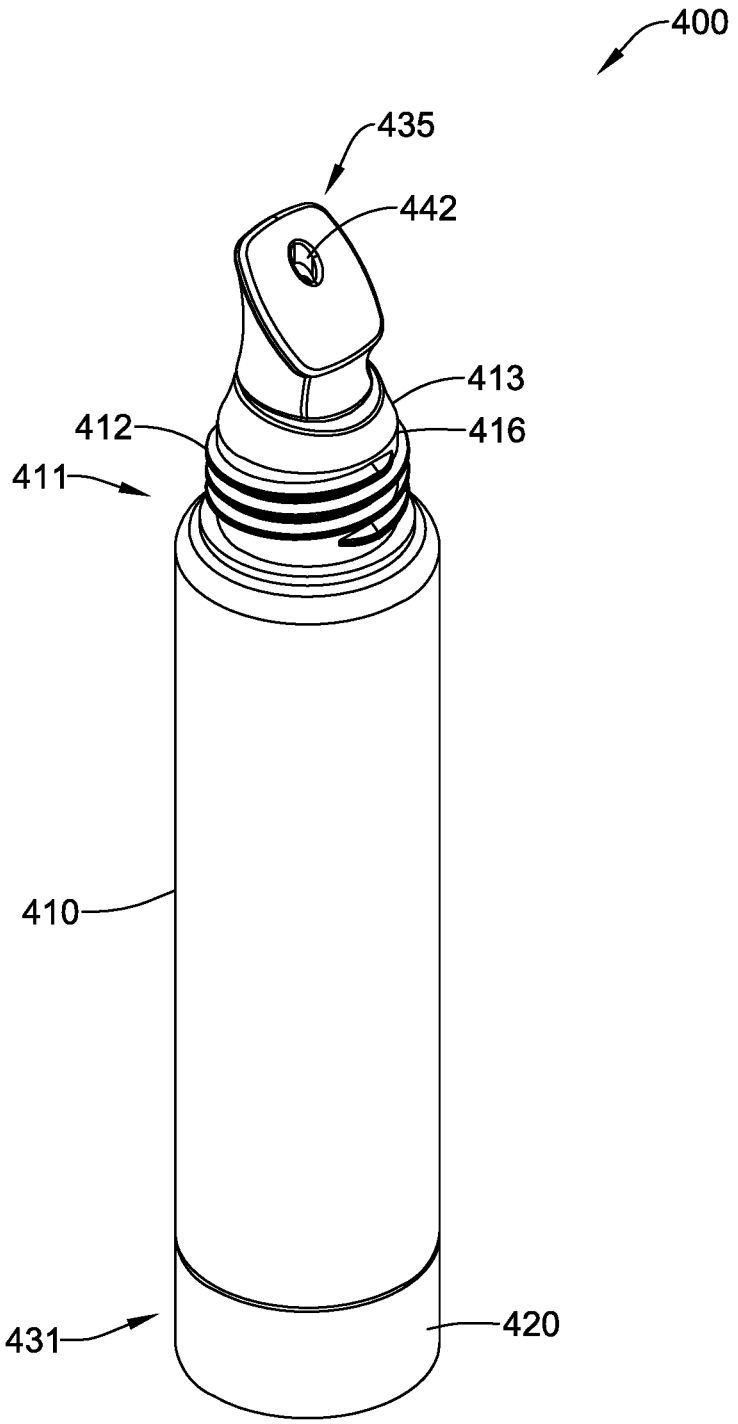
FIG. 17 is a perspective view of the illustrative cosmetic container of FIG. 16, with a top cap removed.
Figure 18:
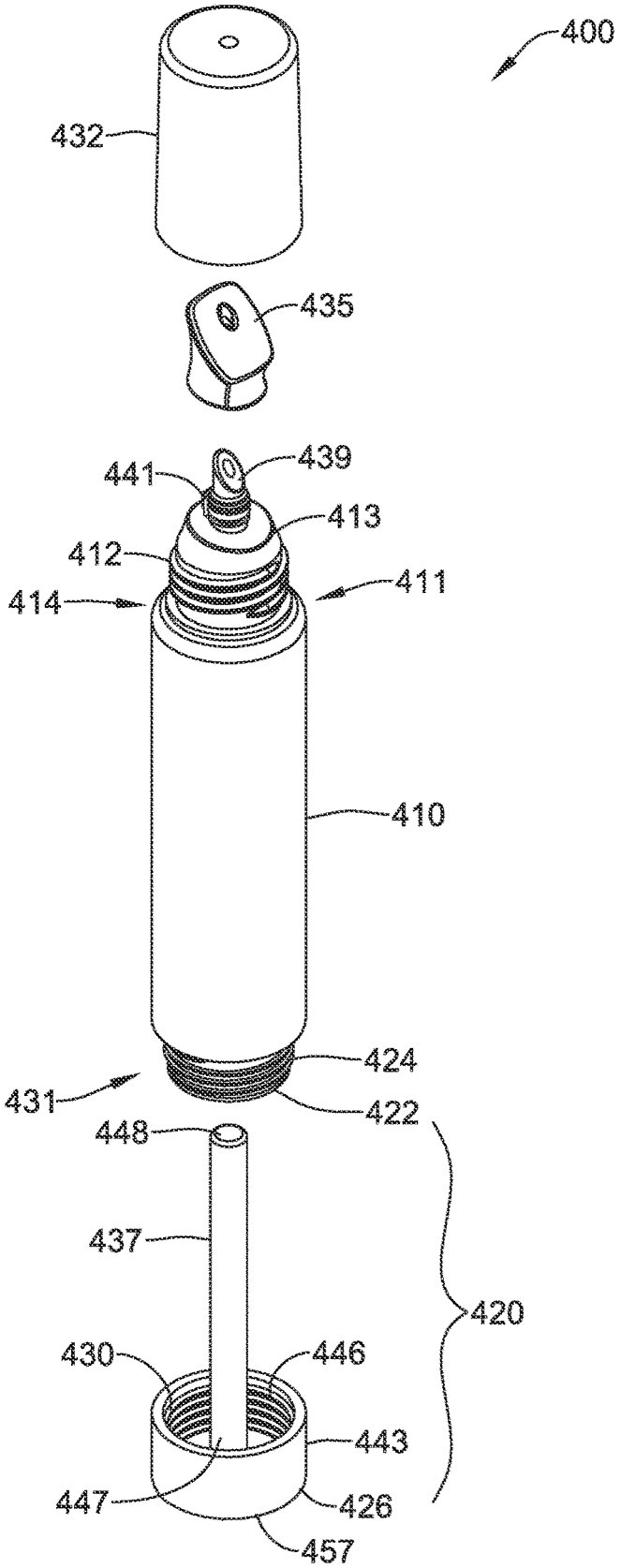
FIG. 18 is an exploded view of the illustrative cosmetic container of FIG. 16.
Figure 19:
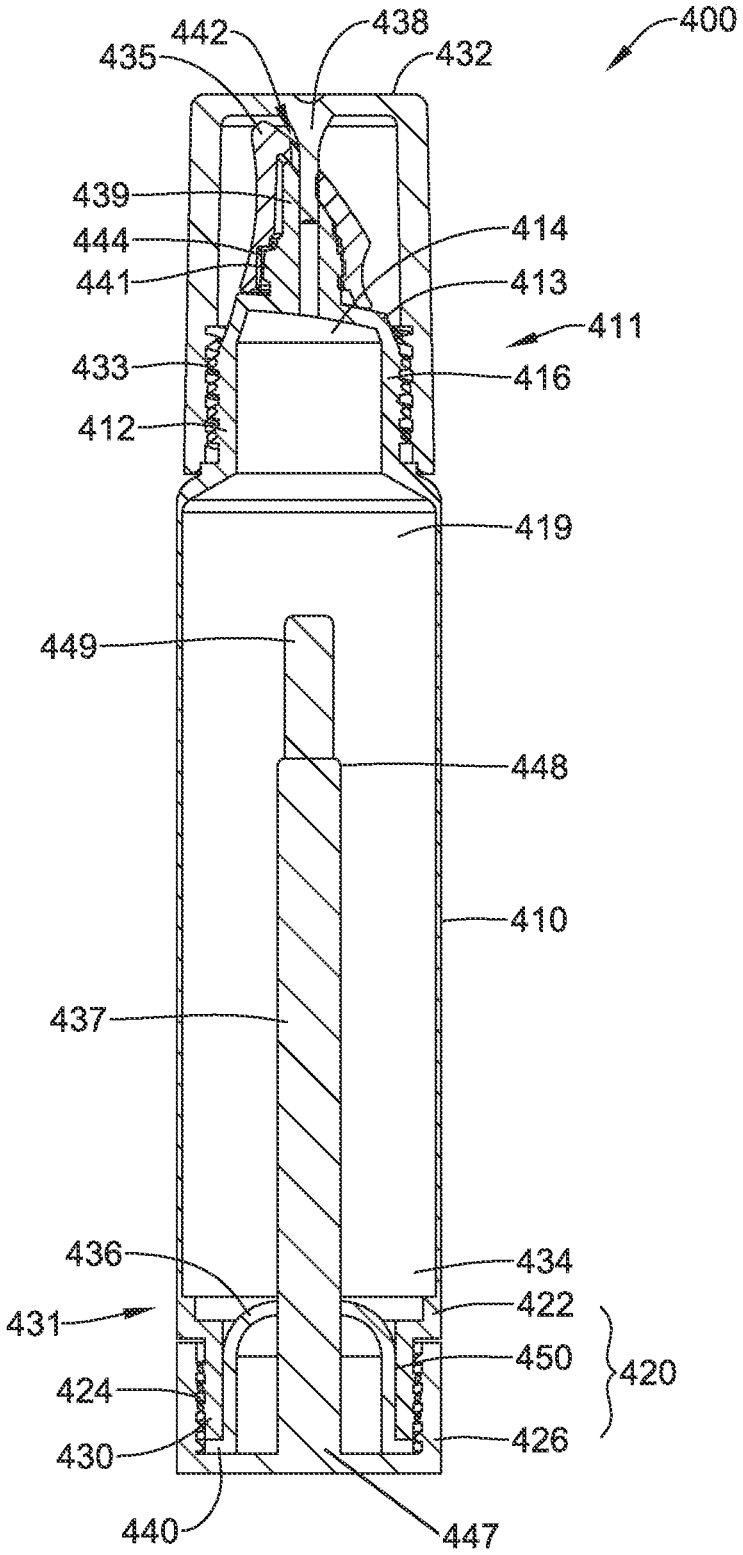
FIG. 19 is a cross-section view of the illustrative cosmetic container as in FIG. 16, taken at lines 19-19.

FIG. 11 illustrates a perspective view of an illustrative cosmetic container 300. As shown in FIG. 11, the cosmetic container 300 may include a tubular sleeve 310, and a cap assembly 320. The sleeve 310 may define a cavity 319, and may include a first end 311 and a second end 331. The first end 311 may include a first opening 314 which may be defined by at least one upper sidewall 313. The sleeve 310 may further include a second opening 334 at the second end 331 of the sleeve 310, as shown in FIG. 12. The upper sidewall 313 may include an inner side 315 and an outer side 316, and the outer side 316 may include outer threads 312. In some embodiments, the first opening 314 defined by the at least one upper sidewall 313 may be configured to engage with a nozzle, a cap, a brush, a sponge, an applicator, or the like, as shown in FIGS. 17-19, but this is not necessary. The cap assembly 320 may include an inner cap 322 and an outer cap 326. The cosmetic container 300 may include the tubular sleeve 310 having a cylindrical shape and the cap assembly 320 having a circular shape, as shown in FIGS. 12-15B. Alternatively, the cosmetic container 300 may have a shape that is circular, square, rectangular, triangular, oval, or any other desired shape.

FIG. 12 illustrates an exploded view of the illustrative cosmetic container 300. As shown in FIG. 12, the cosmetic container 300 may include the sleeve 310 defining the cavity 319 for receiving a cosmetic product such as, liquids, creams, gels, and various makeup products such as foundation, concealer, lotion serum, petroleum products, sunscreen, etc. The cosmetic container 300 may further include the cap assembly 320 which may include the inner cap 322 and the outer cap 326. The inner cap 322 may include an inner wall 321 and an outer wall 323. The outer wall may include an upper ridge 325, and a tab 327 for coupling the inner cap 322 to the outer cap 326. The inner cap 322 may be adapted for placement at or around the second end 331 of the sleeve 310 (as shown further in FIGS. 15A-15B). The inner cap 322 may be attached to the sleeve 310 via heat-welding, injection molding, adhesion, or any other suitable method of attachment.

The outer cap 326 may include a bottom 329, an inner wall 330, and an outer wall 332. The outer wall 332 may include an inner slot 333. The inner slot 333 may be configured to engage with the tab 327 of the inner cap 322 for coupling the outer cap 326 to the inner cap 322 so as to provide a snap-fit between the outer cap 326 and the inner cap 322 and seal the second opening 334 of the second end 331 of the sleeve 310. Alternatively, the outer cap 326 may include inner threads and the inner cap may include outer threads, and instead of a snap fit or interference fit, threaded coupling may be used. In some cases, the cap assembly 320 may include an O-ring (not shown), which may be configured to be placed around the outer wall 323 of the inner cap 322, such that when assembled, the inner cap 322 and the outer cap 326 can compress the O-ring interposed by the inner cap 322 and the outer cap 326 to achieve an airtight seal.

Figure 15A:
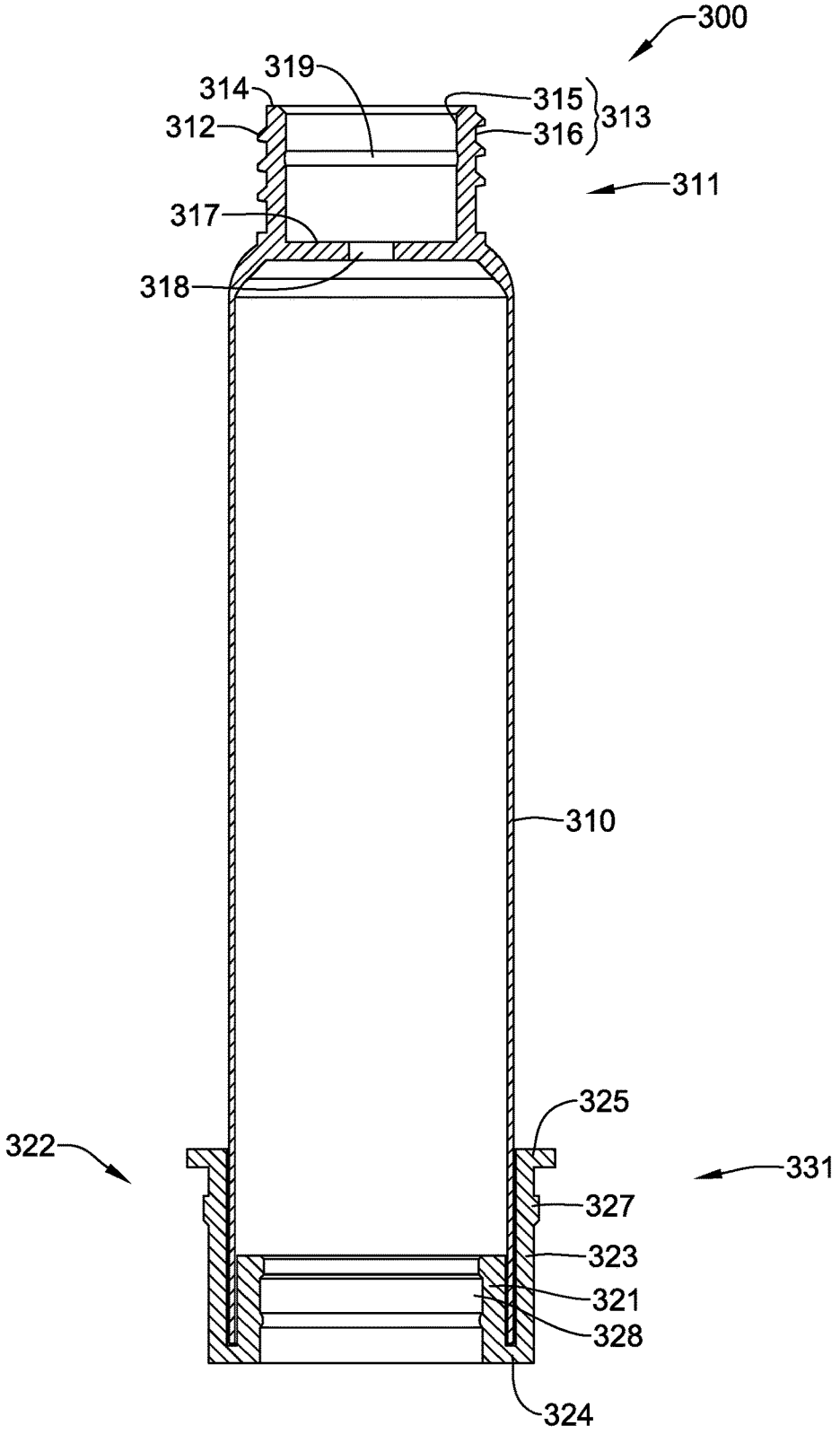
FIG. 15A is a cross-section view of the illustrative cosmetic container as in FIG. 11, taken at lines 15-15, with the cap removed.
Figure 15B:
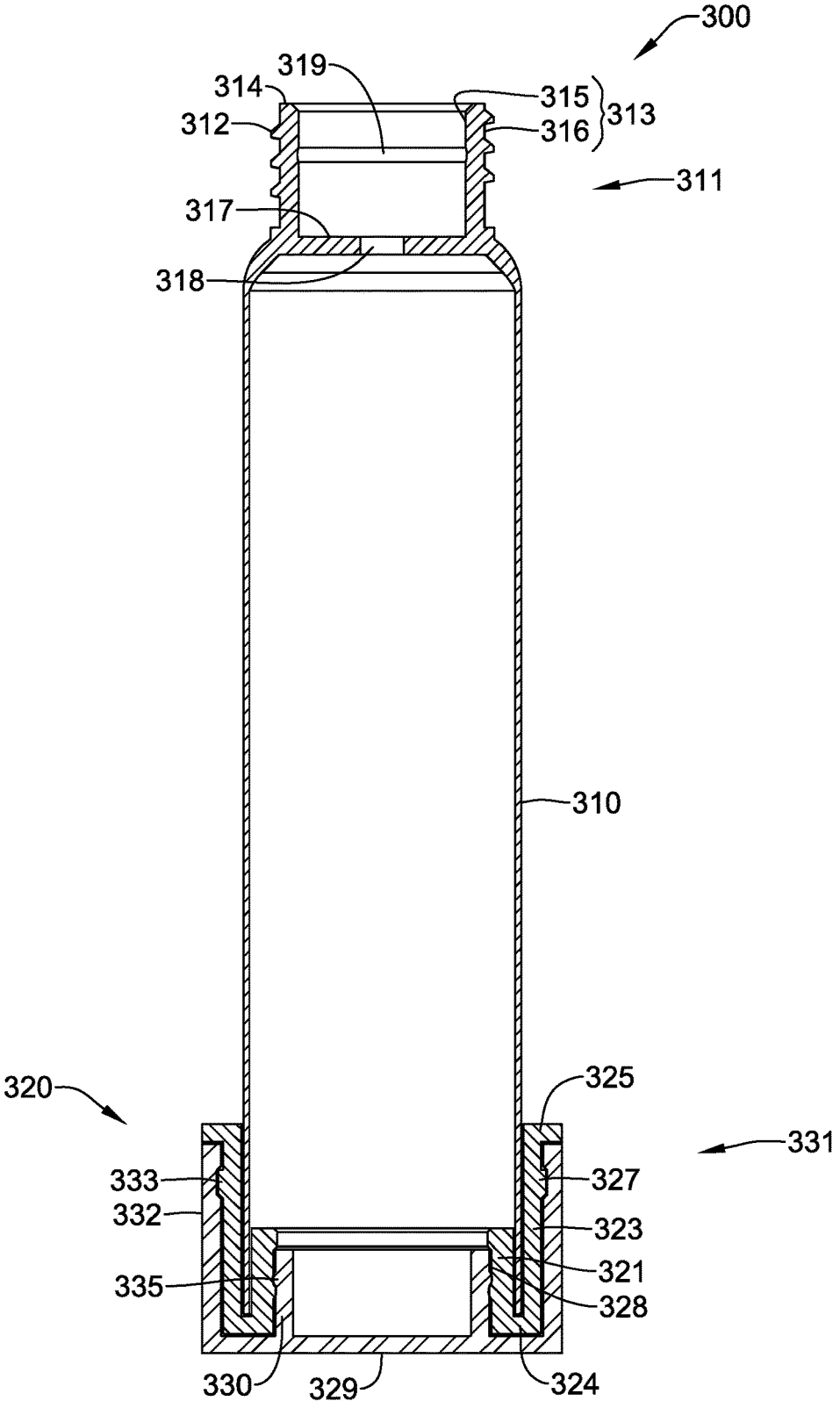
FIG. 15B is a cross-section view of the illustrative cosmetic container as in FIG. 11, taken at lines 15-15.

The outer cap 326 and the inner cap 322 assemblies (e.g., cap assembly 320) may have a substantially round (e.g., cylindrical) shape in which the seal may be provided by a snap fit mechanism, as shown in FIGS. 12, 15A and 15B. However, it is contemplated that the outer cap 326 and the inner cap 322 may have an alternative shape (e.g., square, rectangular, oval, triangular, or any other shape desired) and may be sealed by a magnetic fastening mechanism or a clamp fastening system. It may be further contemplated that the outer cap 326 and the inner cap 322 have one shape, such as a square, and inner pieces have a second, substantially round shape, wherein closure may be provided by a thread fastening mechanism.

Figure 13:
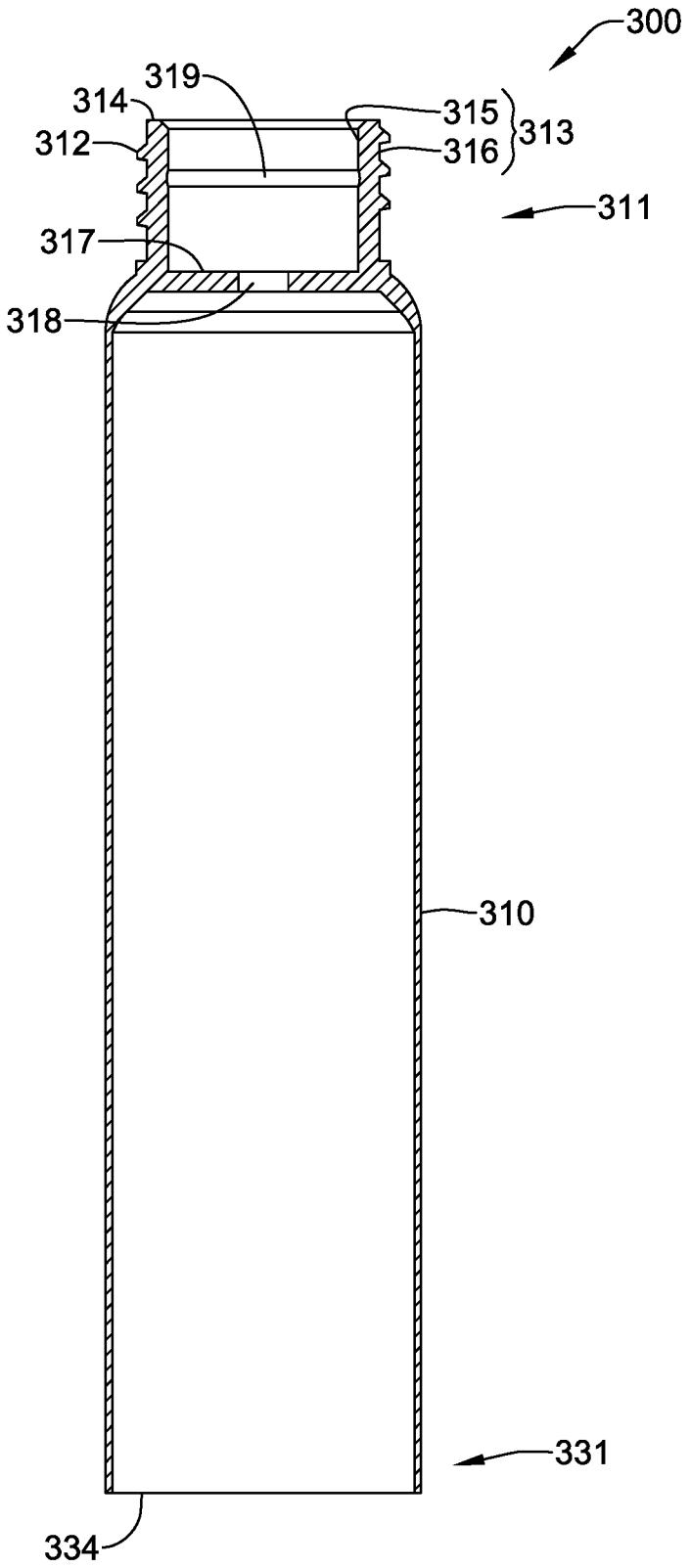
FIG. 13 is a cross-section view of an illustrative tubular sleeve as in FIG. 12, taken at lines 13-13.

FIG. 13 illustrates a cross-section view of the illustrative tubular sleeve 210 as in FIG. 12, taken at lines 13-13. As discussed with reference to FIGS. 11 and 12, the sleeve 310 may define the cavity 319 for receiving a cosmetic product. The sleeve 310 may include the first end 311 which may include the first opening 314 defined by the at least one upper sidewall 313. The upper sidewall 313 may include the inner side 315 and the outer side 316, and the outer side 316 may include the outer threads 312. The first end 311 may be formed by injection molding the first end 311 onto the sleeve 310. The sleeve 310 may further include the second end 331 which may include the second opening 334. The second opening 334 may allow access to the cavity 319 within the sleeve 310, thereby allowing the cavity 319 of the sleeve 310 to be filled with a cosmetic product. In some embodiments, the second opening 334 may have a cylindrical shape, as illustrated in FIGS. 11-15B, which may be configured to engage with the cap assembly 320, as shown further in FIGS. 15A-15B. It may be contemplated that the second opening 334 may have any other suitable shape (e.g., conical, frustoconical, cylindrical, oval, or the like).

As shown in FIG. 13, the first end 311 of the sleeve 310 may include a lower end 317 and an opening 318 within the lower end 317. The lower end 317 may provide a barrier between a cosmetic product contained within the sleeve 310 and the first opening 314 of the sleeve 310. The opening 318 may be provided in the lower end 317 to allow access to the cosmetic product after the sleeve 310 has been sealed. The lower end 317 and the opening 318 together may prevent unintentional spillage of the cosmetic product and/or may prevent a user from acquiring more cosmetic product than intended. In some embodiments, the opening 318 may be a hole provided at a center of the lower end 317, as illustrated in FIG. 13. In other embodiments, the opening 318 may include two or more holes. In some embodiments, the lower end 317 and the opening 318 may not be included. These are just some examples.

Figure 14:
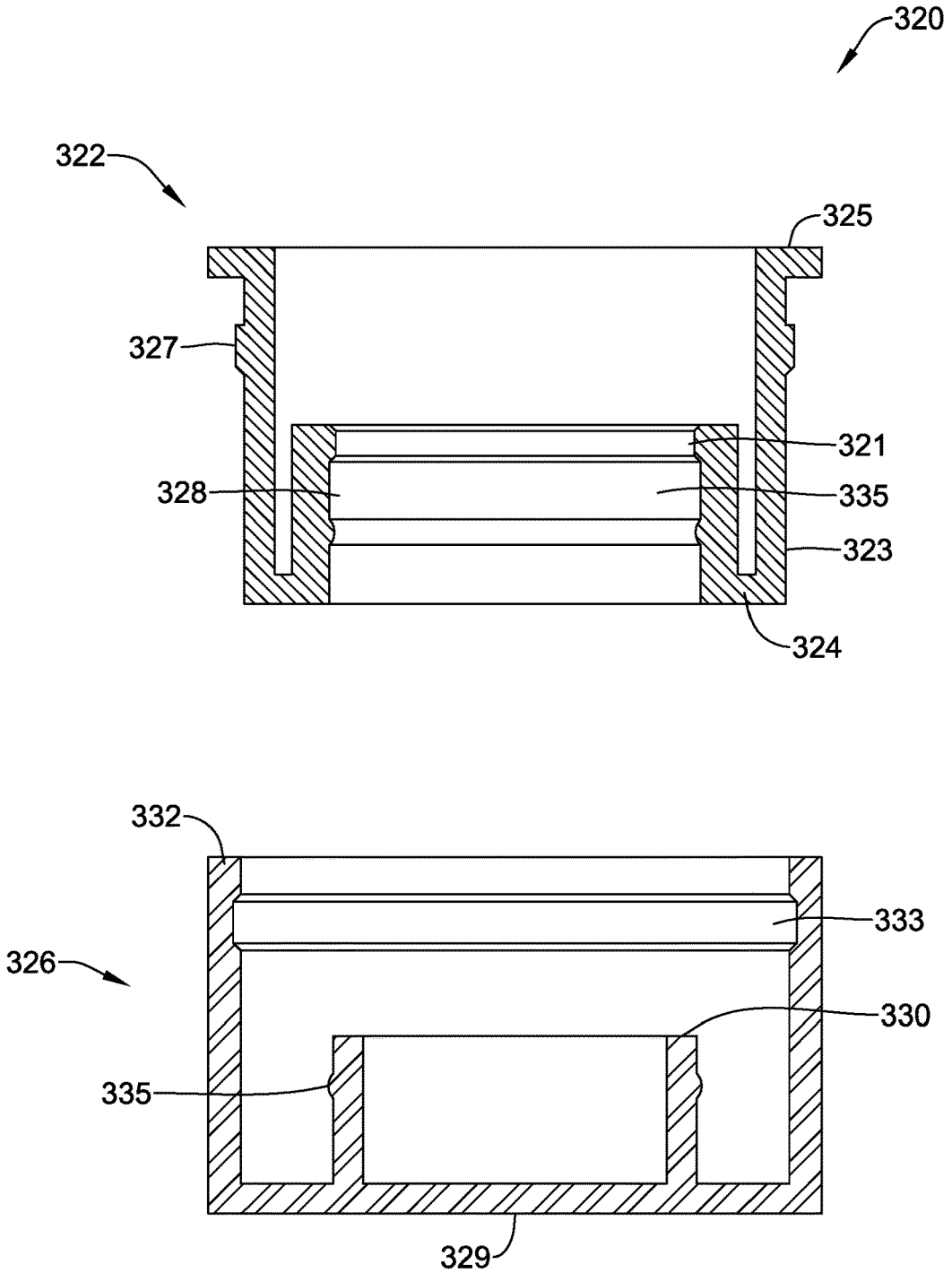
FIG. 14 is a cross-section view of an illustrative cap assembly as in FIG. 12, taken at lines 14-14.

FIG. 14 illustrates a cross-section view of the illustrative cap assembly 320 as in FIG. 12, taken at lines 14-14. As discussed with reference to FIGS. 11 and 12, the cap assembly 320 may include the inner cap 322 and the outer cap 326. The inner cap 322 may include the inner wall 321 and the outer wall 323. The inner wall 321 and the outer wall 323 may be separated by a gap and may be joined together by a lower rim 324. The inner wall 321 may be configured to extend into the cavity 319 of the sleeve 310 and the lower rim 324 may serve as a stop for the inner cap 322, as shown further with reference to FIGS. 15A and 15B. The inner wall 321 of the inner cap 322 may include the slot 328 on an inner side 315 of the inner wall 321, which may be configured to engage with the outer cap 326. The outer wall 323 of the inner cap 322 may include the tab 327 for coupling the inner cap 322 to the outer cap 326, and the upper ridge 325. The outer wall 323 may be configured to fit around sleeve 310 such that the sleeve 310 may be held between the inner wall 321 and the outer wall 323 of the inner cap 322.

The outer cap 326 may include the bottom 329, the inner wall 330, and the outer wall 332. The inner wall 330 of the outer cap 326 may be positioned within the inner wall 321 of the inner cap 322, and the outer wall 332 of the outer cap 326 may be configured to be positioned around the outer wall 323 of the inner cap 322. The inner wall 330 of the outer cap 326 may include an outer ridge 335, which may be configured to fit within the slot 328 of the inner wall 321 of the inner cap 322, in a snap fit fashion. The outer wall 332 of the outer cap 326 may include the inner slot 333, which may be configured to engage with the tab 327 of the outer wall 323 of the inner cap 322. In some examples, the inner wall 330 of the outer cap 326 may be omitted, and the engagement of the inner slot 333 and the tab 327 may connect the inner cap 322 and the outer cap 326 in a snap fit fashion. The upper ridge 325 of the inner cap 322 may have a width greater than the outer wall 323 of the inner cap 322, such than when the outer cap 326 is placed over the inner cap 322 and snapped into place, the cap assembly 320 may have a flush appearance.

FIGS. 15A-15B illustrate cross-section views of the illustrative cosmetic container 300 as in FIG. 11, taken at lines 15-15. FIG. 15A shows the cosmetic container 300 with the outer cap 326 removed. As discussed above with reference to FIG. 14, the inner cap 322 may include the inner wall 321 and the outer wall 323. The inner wall 321 and the outer wall 323 may be separated by a gap and may be joined together by the lower rim 324. The inner wall 321 may be configured to extend into the cavity 319 of the sleeve 310, and the lower rim 324 may serve as a stop for the inner cap 322. The inner wall 321 of the inner cap 322 may include the slot 328 on the inner side 315 of the inner wall 321, which may be configured to engage with the outer ridge 335 of the outer cap 326. The outer wall 323 of the inner cap 322 may include the tab 327 for coupling the inner cap 322 to the outer cap 326, and the upper ridge 325. The outer wall 323 may be configured to fit around sleeve 310, and the gap may be sized such that when the inner cap 322 is engaged with the sleeve 310, the sleeve 310 may be held between the inner wall 321 and the outer wall 323 of the inner cap 322. In some embodiments, the inner cap 322 may be attached to the sleeve 310 via heat-welding, injection molding, adhesion, or any other suitable method of attachment.

As shown in FIG. 15B, the outer cap 326 may be snap fit over the inner cap 322 so as to seal the second opening 334 of the sleeve 310. As discussed above with reference to FIG. 14, the outer cap 326 may include the bottom 329, the inner wall 330, and the outer wall 332. The bottom 329 of the outer cap 326 may form the bottom of the cosmetic container 300. The inner wall 330 of the outer cap 326 may be positioned within the inner wall 321 of the inner cap 322. When a force is applied (e.g., a push force) the outer ridge 335 of the inner wall 330 of the outer cap 326 may "snap into" the slot 328 of the inner cap 322. In some cases, the inner wall 33

The outer wall 332 of the outer cap 326 may be configured to be positioned around the outer wall 323 of the inner cap 322. The outer wall 332 of the outer cap 326 may include the inner slot 333, which may be configured to engage with the tab 327 of the outer wall 323 of the inner cap 322. When the force is applied, the tab 327 of the outer wall 323 of the inner cap 322 may "snap into" the inner slot 333 of the outer cap 326 while simultaneously, the outer ridge 335 of the inner wall 330 of the outer cap 326 may "snap into" the slot 328 of the inner cap 322. The upper ridge 325 of the inner cap 322 may have a width greater than the outer wall 323 of the inner cap 322, such than when the outer cap 326 is placed over the inner cap 322 and snapped into place, the cap assembly 320 may have a flush appearance. Alternatively, in other embodiments, the outer cap 326 may include inner threads and the inner cap 322 may include outer threads, and instead of a snap fit or interference fit, threaded coupling may be used.

Figure 16:
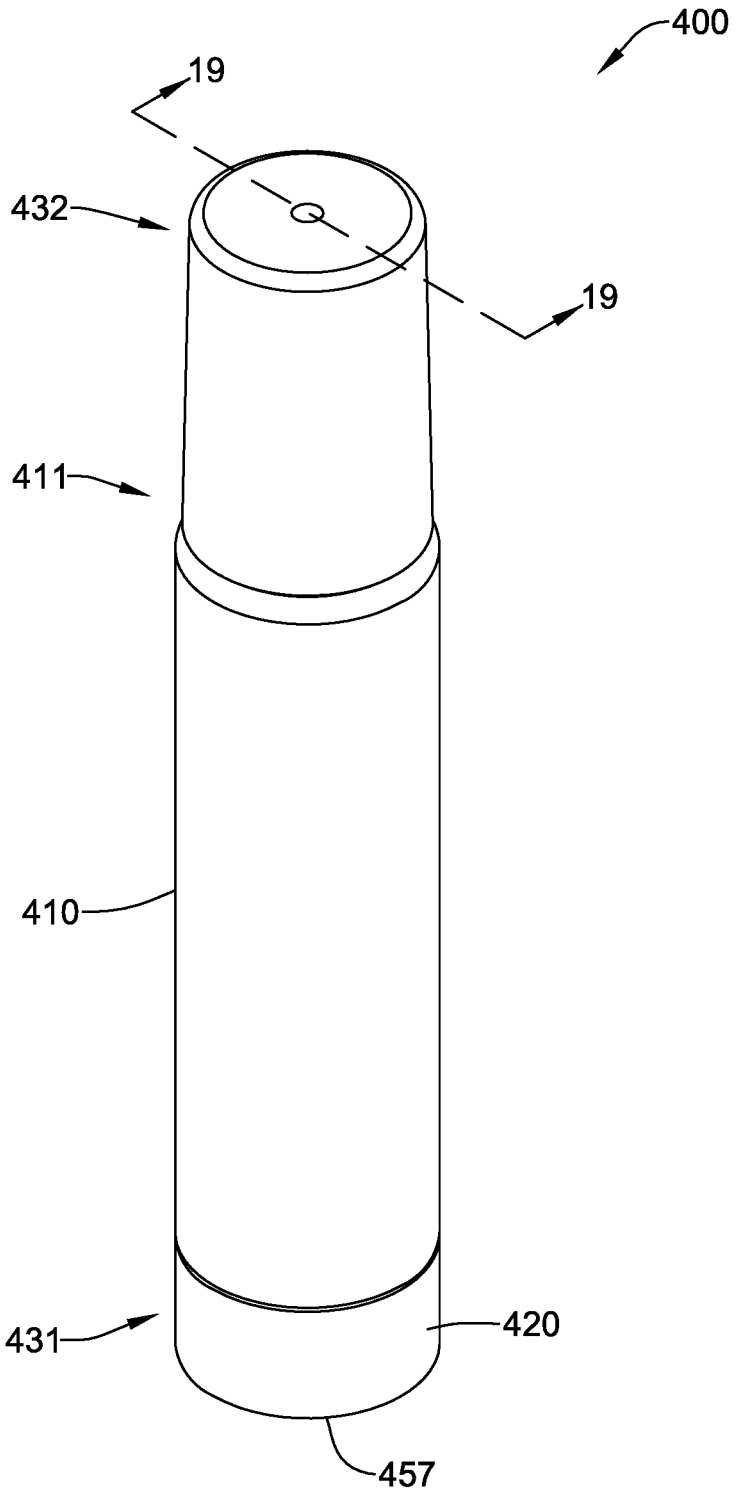
FIG. 16 is a perspective view of an illustrative cosmetic container.

FIG. 16 is a perspective view of an illustrative cosmetic container 400. As shown in FIG. 16, the cosmetic container 400 may include a top cap 432, a tubular sleeve 410, and a cap assembly 420. The sleeve 410 may have a cylindrical shape and the cap assembly 420 having a circular shape, as shown in FIGS. 16-19. Alternatively, the cosmetic container 400 may have a shape that is circular, square, rectangular, triangular, oval, or any other desired shape. The sleeve 410 may define a cavity 419 (as shown in FIG. 19), and may include a first end 411 and a second end 431. The first end 411 may include a first opening 414 which may be defined by at least one upper sidewall 413. The sleeve 410 may further include a second opening 434 at the second end 431 of the sleeve 410, as shown in FIGS. 18-19. The sleeve 410 may be formed from a soft or flexible material (e.g., polypropylene, polyethylene, etc.) which may have a thickness of about 0.1 mm to about 2.0 mm, such that a user may squeeze the sleeve 410 to dispense a cosmetic product contained within the sleeve 410 through the first end 411 and/or an applicator (e.g., first applicator 435). In another example, the thickness may be about 0.1 mm to about 1 mm. In another example, the thickness may be about 0.1 mm to about 0.7 mm. The assembly, when completed, may be used to create an airtight or hermetic seal. In some examples the sleeve 410 is a piece of extruded tube.

FIG. 17 is a perspective view of the illustrative cosmetic container 400 of FIG. 16, with the top cap 432 removed. As shown in FIG. 17, the upper sidewall 413 may include an outer side 416, and the outer side 416 may include outer threads 412. In some embodiments, as seen in FIG. 17, the first opening 414 (as shown in FIG. 19) defined by a dispenser and at least one upper sidewall 413 which are configured to engage with a first applicator 435. In some examples, the first applicator 435 may include an aperture 442 through which a cosmetic product contained within the sleeve 410 may pass. In other examples, the first applicator 435 may be a brush, a doefoot, a sponge, or an applicator for applying liquid eyeliner or a lip gloss contained within the sleeve 410. In some examples, the first applicator 435 may be formed from metal or ceramic, which may provide a cooling effect when used to apply the product contained within the sleeve 410. In some examples, the cosmetic container 400 may include a pump structure and/or an airless pump structure (not shown) including, for example, a valve and piston. These are just examples.

FIG. 18 is an exploded view of the illustrative cosmetic container 400 of FIG. 16. As shown in FIG. 18, the cosmetic container 400 may include the sleeve 410 having the first end 411 and the second end 431. The first end 411 of the sleeve 410 may include the first opening 414 which may be defined by the at least one upper sidewall 413 that forms part of a receiving structure or dispenser 439 that is configured to engage with the first applicator 435. The dispenser 439 may include a tab 441 (as shown in FIG. 19), such that the first applicator 435 may snap on to the dispenser 439. Rather than a tab, a slot indentation, ring, or threading may be provided to secure the first applicator 435.

The outer side 416 of the upper sidewall 413 may include outer threads 412. The outer threads 412 may be configured to engage with inner threads 433 of the top cap 432. The top cap 432 may be placed over the first applicator 435, thereby aligning the inner threads 433 with the outer threads 412. Engagement of the outer threads 412 and the inner threads 433 may serve to close the first end 411 of the sleeve 410 (e.g., close the cosmetic container 400). Alternatively, the top cap 432 may not include inner threads 433 and the outer side 416 of the upper sidewall 413 may not include outer threads 412, and instead snap fit or interference fit may be used in place of the threaded coupling.

The cosmetic container 400 may further include the cap assembly 420 which may include an inner cap 422 and an outer cap 426 at the second end 431 of the sleeve 410. The inner cap 422 may include an outer side may include outer threads 424. The inner cap 422 may be adapted for placement at or adjacent the second end 431 of the sleeve 410 (as shown further in FIG. 19). The inner cap 422 may be attached to the sleeve 410 via welding, injection molding, adhesion, mechanical fixation, and/or any other suitable method of attachment. When assembled, the inner cap 422 may be secured to the sleeve 410 such that the inner cap 422 may not rotate relative to the sleeve 410.

The outer cap 426 may include a bottom 457, an inner wall 446, and an outer wall 443. The outer wall 443 may include inner threads 430. The inner threads 430 may be configured to engage with the outer threads 424 of the inner cap 422 for coupling the outer cap 426 to the inner cap 422 so as to seal a second opening 434 of the second end 431 of the sleeve 410. Alternatively, the outer cap 426 may not include inner threads 430 and the inner cap 422 may not include outer threads 424, and instead snap fit or interference fit may be used in place of the threaded coupling. When assembled, the coupling of the outer cap 426 to the inner cap 422 may seal the second opening 434 of the second end 431 of the sleeve 410. Alternatively or additionally, disengagement of the outer cap 426 from the inner cap 422 may allow access to the cavity 419 of the sleeve 410, thereby allowing access to the cosmetic product contained within, and/or allow access to refill the sleeve 410 once the product contained within has been depleted.

The cap assembly 420 (e.g., the inner cap 422 and the outer cap 426) may have a substantially round (e.g., cylindrical) shape in which the seal may be provided by a thread fastening mechanism, as shown in FIGS. 16-19. However, it is contemplated that the inner cap 422 and the outer cap 426 may have an alternative shape (e.g., square, rectangular, oval, triangular, or any other shape desired) and may be sealed by a magnetic fastening mechanism, a snap fastening mechanism (e.g., a snap fit) or a clamp fastening system. It may be further contemplated that the inner cap 422 and the outer cap 426 have one shape, such as a square, and inner pieces have a second, substantially round shape, wherein closure may be provided by a thread, snap, or other suitable fastening mechanism. In some cases, the cap assembly 420 may include an O-ring (not shown), placed around the outer side of the inner cap 422, or a gasket on an inner side of the outer cap 426, such that when assembled, the inner cap 422 and the outer cap 426 can compress the O-ring or gasket to provide an airtight or hermetic seal.

As shown in FIG. 18, the outer cap 426 may include a stem 437. The stem 437 may include a proximal end 447 and a distal end 448. The distal end 448 may be adapted to receive an applicator (e.g., second applicator 449, as shown in FIG. 19). The stem 437 may be configured to extend into the cavity 419 of the sleeve 410. When the stem 437 having an applicator is included, a user may rotate the outer cap 426 relative to the sleeve 410 and thereby the inner cap 422 to remove the outer cap 426 and the stem 437 from the sleeve 410. In this manner, a user may use the stem 437 and the attached applicator to apply the product contained within the sleeve 410.

FIG. 19 is a cross-section view of the illustrative cosmetic container 400 as in FIG. 16, taken at lines 19-19. As shown in FIG. 19, the cosmetic container 400 may include the sleeve 410 defining the cavity 419 for receiving a cosmetic product such as, liquids, creams, gels, and various makeup products such as foundation, concealer, lotion serum, petroleum products, sunscreen, etc. The cosmetic container 400 may include the top cap 432, which may include a pintel 438. The pintel 438 may be adapted to fit within the aperture 442 of the first applicator 435 when the top cap 432 is threaded onto the cosmetic container 400. The pintel 438 may serve to seal the aperture 442 of the first applicator 435 to prevent the product contained within the sleeve 410. Such sealing action may occur relative to either the aperture 442 of the first applicator 435 and/or relative to the opening of the termination of the passageway through the dispenser 439, as by abutting, entering, or partly entering the tip of the dispenser 439. For example, in use, a user may flip the cosmetic container 400 "upside down" to remove the outer cap 426 and the stem 437 and apply a product. In this case, in order to prevent the product from inadvertently spilling out of the aperture 442, the pintel 438 fits within the aperture 442 and prevents product by spilling out.

The first applicator 435 may be coupled to the dispenser 439. The dispenser 439 may include the tab 441 configured to engage with the inner channel 444 of the first applicator 435 which prevents rotation of the first applicator 435 relative to the dispenser. An annular ridge or protrusion may also be seen level with the tab 441, which serves to allow snap fit of the first applicator 435 onto the dispenser 439. Other coupling mechanisms between the first applicator and the dispenser are 439 contemplated as well, such as threading, friction fit, slot-twist (an L-shaped slot with an indentation at the furthest extent thereof to receive and secure a corresponding protrusion), magnet, etc. While such reversible attachment is generally sufficient, irreversible attachment is also contemplated, including for example the use of an adhesive attachment.

As discussed, the cap assembly 420 may include the inner cap 422 and the outer cap 426. The outer cap 426 may include the stem 437 which may include the second applicator 449. The second applicator 449 may be a brush, a doefoot, a sponge, or an applicator for applying liquid eyeliner or a lip gloss (or other cosmetic product such as a cream, lotion, concealer, foundation, hair care product, eye gel, etc.) contained within the sleeve 410. In some examples the second applicator may be a metal or ceramic capable of providing a cooling effect. The second applicator 449 may also be a dropper, in which case the outer cap may have a flexible portion or button to actuate the dropper.

The container 400 may further include a wiper 436, as shown in FIG. 19. The wiper 436 may be adapted for placement within an inner side 450 of in the inner cap 422. The wiper 436 may be held within the inner cap 422 via friction fit or any other suitable method of attachment. The wiper 436 may include an outer lip 440 which may engage with a bottom side of the inner cap 422. The outer lip 440 of the wiper 436 may serve as a stop for the wiper 436, thereby preventing the wiper 436 from advancing into the cavity 419 of the sleeve 410. The stem 437 and the second applicator 449 of the outer cap 426 may be configured to pass through the wiper 436. The wiper 436 may control the amount of product that may be removed from the sleeve 410. For example, when the stem 437 and the second applicator 449 pass through the wiper 436, excess cosmetic product may be removed from the second applicator 449. While the cosmetic container 400 is depicted as including the wiper 436, this is not necessary. In some examples, a removeable or non-removeable cap may be provided at the second end to couple to the inner cap 422, rather than an applicator as shown in FIGS. 18-19. The applicator as shown in FIGS. 18-19 may also be included in the examples of FIGS. 1-15, if desired, if the bottom cap of such examples is a removable piece (such as when applied using threading as in FIGS. 1-5C).

Figure 20:
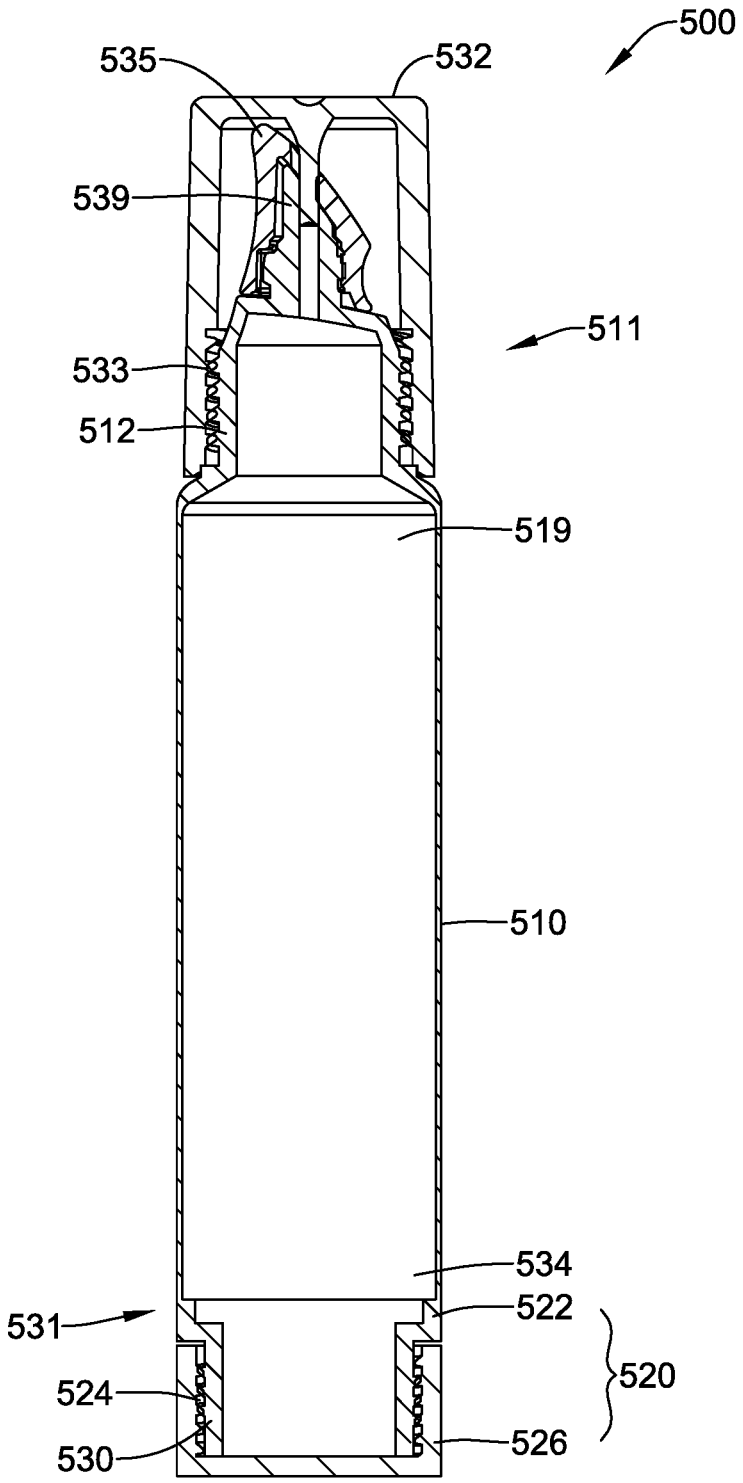
FIG. 20 is a cross-section view of an illustrative cosmetic container for an alternative design, wherein an external view would look similar to FIG. 16 and the section is taken along lines 19-19.

FIG. 20 is a cross-section view of an alternative design which is in several respects similar to that of FIG. 19. An external perspective view could be as shown in FIG. 16, and the section would be along line 19-19 of FIG. 16. In this design, the second applicator is omitted. Thus, as shown in FIG. 20, the illustrative cosmetic container 500 includes a sleeve 510 defining a cavity 519 for receiving a cosmetic product such as, liquids, creams, gels, and various makeup products such as foundation, concealer, lotion serum, petroleum products, sunscreen, etc. The sleeve 510 may be an extruded piece.

A top cap 532 is shown covering an applicator 535 which is held in place over a dispenser 539. The cap 532 has inner threads 533 that engage outer threads 512 on a sidewall of the first end 511 of the container. The inner applicator 539 and outer threads 512 may be formed by insert molding onto the sleeve 510.

At the second end 531 of the sleeve 510 a lower cap assembly 520 is shown. The lower cap assembly includes an inner cap 522 having outer threads 524 thereon, which couple to an outer cap 526 having inner threads 530. The outer cap 526 is thus used to seal the opening 534 of the sleeve at the second end 531 by screwing onto the inner cap 522. A gasket or O-ring may be provided in the lower cap assembly 520 to enhance sealing, if desired. No wiper is needed at the second end 531 in this example because no second applicator is provided. In use, the second cap 526 may be removed to allow filling and/or refilling of the cosmetic container 500. In another example, a non-removable cap is provided such as by using an aggressive one-way snap that allows the cap to be screwed on, but which makes it very difficult to screw the cap off. For example, threading on the surfaces may have a texture that allows for threading the cap on, but prevents threading the cap off. A threaded attachment may have a snap or protrusion at the end of one or the other, or both, sets of threads of an inner and outer thread combination, such that once fully threaded on, the snap prevents removal. In another example, a cap may be threaded on and over-turned, going beyond the end of threading extend causing damage to the threading and preventing removal.

The applicator 535 may be any suitable applicator, such as a thermal tip (ceramic or metal, for example, as described in U.S. Pat. Nos. 7,883,287, 9,498,042 and/or 9,538,824, the disclosures of which are incorporated herein by reference, a plastic or gel tip, or a brush, sponge, etc. Although not shown, a sealing O-ring or gasket may be included in cap 526.

In the example of FIG. 20, as well as the preceding examples, rather than threading to secure the caps 532 and 526, snap fit or interference fit may be used, if desired.

For each of FIGS. 19 and 20, for manufacturing purposes, either end of the sleeve 410/510 (also referred to as a tube) may be formed by molding additional material thereon. In an example, the structure added to the first end 411/511 may be formed by insert molding onto the sleeve, thereby adding material to form the outer threads 433/533 and associated upper sidewall, as well as the dispenser 439/539, using a mandrel that is inserted through the second end 431/531 of the sleeve 410/510. After insert molding the first end structure is complete and the mandrel is removed, a separately formed inner cap 422/522 may be attached to the second end 431/531 of the sleeve 410/510 by mechanical fixation, by sonic or heat welding, or via adhesive, or a combination thereof; heat shrinking may be used as well. For example, the pieces may be placed and held in position using mechanical fixation, with added fixation by applying heat or sonic welding. In another example, the pieces may be placed using adhesive and also mechanically fixed in place. Other combinations of fixation may be used.

In an alternative, the second end 431/531 structure may be formed by insert molding the inner cap 422/522 onto the sleeve 410/510 using a mandrel inserted through the first end 411/511 of the sleeve 410/510. After the insert molding is complete and the mandrel is removed, a separately formed top piece comprising the threads 433/533 on the upper sidewall and dispenser 439/539 can be secured to the first end 411/511 of the sleeve 410/510 using mechanical fixation, sonic or heat welding, via adhesive, by heat shrinking, or by a combination thereof. In still another alternative, each of the top piece comprising the threads 533/533 on upper sidewall and the dispenser 439/539, and the inner cap 422/522, may be secured to the sleeve 410/510 using mechanical fixation, sonic or heat welding, via adhesive, by heat shrinking, or by a combination thereof.

It should be noted that the resulting structure is distinct from one construction method to the next. The use of sonic or heat welding causes a small amount of blending of the two materials of the pieces that are joined together along a relatively defined joint region. A challenge with any welding process, particularly with a larger area of weld joint such as a circumferential weld that traverses more than a few millimeters of longitudinal extent, is that the two materials will only blend and attach at locations where the weld energy is sufficient to cause both materials to reach a melting temperature. Adhesive does not blend the two materials at all and will leave a seam having a distinct material contained therein. Insert molding of compatible materials is likely the most secure of these attachment types. In particular, insert molding two pieces of identical materials or highly similar materials, or materials with similar melt temperatures, results in joining at the edges that avoids the appearance of a seam. A seam can be subject to lamination and separation making for an objectively different product if two pieces are heat or sonic welded together, rather than insert molded, and, if visible, subjectively reduces the visual attractiveness of the item. While some examples above use insert molding on one end of the tube and adhesive, welding and/or mechanical pressure on the other end of the tube, some examples make use of insert molding at both ends of the tube.

In the existing manufacturing processes, on which the present invention is an improvement, an insert mold process provides structure on one end of a tube, with the other end of the tube being crimped after filling, rather than having any sort of structure or cap. The construction using insert molding on each end is not a simple matter of "doing the same thing" on both ends of the tube, since the standard, cheap process of placing one insert molded piece on a tube is to insert a large mandrel from the other end of the tube, which can really only be done from one end of the tube; after a structure is inset molded on one end of the tube by standard processes, the identical process cannot be used on the other end of the tube since one end is at least partly blocked or reduced in available diameter. Additional steps, including crimping down onto a mandrel that is smaller than the tube, and/or using a collapsible or multi-part mandrel for molding, are needed.

For example, referring to the above examples, a standard process may be used to insert mold the second end structure first, and a multi-part mandrel having two or more sector-shaped (pie piece shapes) portions that are separately placed alongside one another within the tube for molding the first end structure, after passing through the relatively larger opening of the second end structure. After molding the first end structure, removing and/or disassembling one part of the multi-part mandrel at a time allows the mandrel to be removed easily. In another example, a standard process may be used to insert mold the first end structure, and a multi-part mandrel having two or more sector-shaped pieces is assembled inside the tube with access through the first end (depending on what has been placed on the first end of the tube) or second end of the tube in order to allow the second end to be insert molded onto the tube; crimping the tube onto the mandrel may be used in both steps. A multi-part mandrel may be used for both steps, by introduction through the second end and assembly near the first end, and then sliding within the tube to the second end for another molding step.

Rather than a multi-part mandrel, a radially expandable and collapsible mandrel may be used. For example, a mandrel having a support structure that outwardly extends a structure having partially circumferential, interleaving teeth may be used, in which the overlapping of teeth when fully extended provides support about the entire circumference while having small gaps sufficiently narrow to support the tube during insert molding. Moreover, crimping around the outside of the tube for purposes of insert molding allows pressure to be applied in the region of the mold.

In still another example, both ends of the sleeve 410/510 may be formed using insert molding processes. For example, the first end structure 411/511 may be added in a first step, with placement over a mandrel that extends through the sleeve 410/510 from the second end. Next, the second end structure 420/520 may be added to the sleeve by inserting a mandrel, which may be a collapsible mandrel or a multi-piece mandrel, in through the second end and adding material to form the inner cap 422/522 and threads 424/524. As an alternative, the second end structure 420/520 may be formed first, and a mandrel inserted through the opening in the inner cap 422/522 to support the upper end of the sleeve 410/510, wherein the mandrel may be a collapsible mandrel or it may be sized to fit through the opening in the inner cap 422/522 with the upper end of the sleeve 410/510 crimped onto the mandrel to a provide the step down in diameter that is apparent at 412/512, with added material insert molded thereon to form the structures on the first end 411/511.

The use of an extruded tube with elements added to each end is also an improvement over the use of standard molding to form the tube along with features at each end. For example, it is common to mold a tube having a first end with a receiving structure, such as threads, tabs, ring, etc. to which a dispenser and/or applicator are attached. Extrusions allow different materials, and different surface finishes to be achieved.

An example method of filling a cosmetic container (e.g., cosmetic containers 100, 200, 300, 400 and/or 500) may include forming a tubular sleeve. The tubular sleeve may define a cavity, and may include a first end with a first opening and a second end with a second opening. The first opening may be defined by at least one upper sidewall, which may have an inner side, an outer side, and a lower end. The outer side of the upper sidewall may include outer threads. The tubular sleeve may be formed in any suitable manner, such as by extrusion. The first end of the tubular sleeve may be formed by injection molding. After the first end is provided on the tubular sleeve, the tubular sleeve may be filled with product; in some example, a cap ring is first insert molded onto the second end of the tubular sleeve prior to filling. The cosmetic product may include, but are not limited to, liquids, creams, gels, and various makeup products such as foundation, concealer, lotion serum, petroleum products, sunscreen, etc. The cosmetic container may then be sealed via a cap assembly (e.g., cap assemblies 120, 220, 320, 420 and/or 520).

In some embodiments, the cosmetic containers 100, 200, 300, 400 and/or 500 and the various components thereof may be made from a flexible or semi-rigid material, such as plastic or aluminum. In some embodiments, the cosmetic containers 100, 200, 300, 400, 500 may comprise a transparent or translucent material so that the cosmetic product may be externally viewed, though in other examples, the tubular sleeve and other elements may be opaque.

The above description is intended to be illustrative, and not restrictive. For example, the above described examples (or one or more aspects thereof) and example method, may be used in combination with each other. Other embodiments can be used, such as by one of ordinary skill in the art upon reviewing the above description.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

What is claimed is:

1. A cosmetic container, comprising:

a tubular sleeve defining a cavity and having a first end with a first opening and a second end with a second opening, and a longitudinal axis extending therebetween;

a combined structure including an upper sidewall and a dispenser, the combined structure attached to the first end of the tubular sleeve, the upper sidewall having an inner side and an outer side and a receiving structure, the outer side including outer threads, the upper sidewall having an outer diameter less than an outer diameter of the tubular sleeve, the dispenser having a passageway extending to at least a portion of an interior of the tubular sleeve;

a cap assembly having an inner cap and an outer cap, wherein the inner cap is molded onto the second end of the tubular sleeve, the inner cap having outer threads on an outer side of the inner cap; and an applicator, wherein the upper sidewall defines a receiving structure configured to extend inside the applicator;

wherein the outer cap has a bottom and an outer wall, the outer wall having inner threads configured to engage with the outer threads of the outer side of the inner cap; and wherein the second opening allows access to the cavity of the tubular sleeve.

2. The cosmetic container of claim 1 wherein:

the tubular sleeve is an extruded tube having a thickness of 0.1 mm to 2 mm;

the combined structure is insert molded onto the first end of the tubular sleeve as a single piece.

3. The cosmetic container of claim 1 wherein:

the tubular sleeve is an extruded tube having a thickness of 0.1 mm to 2 mm;

the combined structure is separately formed and then attached to the tubular sleeve by at least one of mechanical force, adhesive, or welding.

4. The cosmetic container of claim 1 wherein the dispenser comprises an exterior having at least one tab, slot, annular protrusion or indentation for securing to a first applicator adapted for securing to the dispenser, and the cosmetic container further comprises the first applicator.

5. The cosmetic container of claim 4 wherein the first applicator comprises a metal or ceramic applicator.

6. The cosmetic container of claim 4 wherein the outer cap further comprises a stem having a second applicator thereon, the cosmetic container further comprising a wiper adapted for placement within the inner cap, wherein the stem and second applicator are configured to pass through the wiper.

7. The cosmetic container of claim 1, further comprising an O-ring adapted for placement around the outer side of the inner cap to provide a seal between the inner cap and the outer cap.

8. The cosmetic container of claim 1, wherein the tubular sleeve defines a single cavity, wherein the outer cap includes a second applicator, wherein the first applicator and the second applicator are each in fluid communication with the single cavity.

9. The cosmetic container of claim 8, wherein the second applicator is disposed within the single cavity when the outer cap is disposed on the inner cap.

10. A cosmetic container, comprising:

a tubular sleeve defining a cavity and having a first end with a first opening and a second end with a second opening, and a longitudinal axis extending therebetween, a combined structure including an upper sidewall and a dispenser, the combined structure attached to the first end of the tubular sleeve, the upper sidewall having an inner side and an outer side, the outer side including outer threads, the upper sidewall having an outer diameter less than an outer diameter of the tubular sleeve, the dispenser having a passageway extending to at least a portion of an interior of the tubular sleeve;

a cap assembly having an inner cap and an outer cap, wherein the inner cap is molded onto the second end of the tubular sleeve, the inner cap having outer threads on an outer side of the inner cap;

wherein the outer cap has a bottom and an outer wall, the outer wall having inner threads configured to engage with the outer threads of the outer side of the inner cap;

wherein the second opening allows access to the cavity of the tubular sleeve; and wherein the dispenser extends longitudinally beyond the outer threads, away from the tubular sleeve.

11. A cosmetic container, comprising:

a tubular sleeve defining a cavity and having a first end with a first opening and a second end with a second opening, and a longitudinal axis extending therebetween;

a combined structure including an upper sidewall and a dispenser, the combined structure attached to the first end of the tubular sleeve, the upper sidewall having an inner side and an outer side, the outer side including outer threads, the upper sidewall having an outer diameter less than an outer diameter of the tubular sleeve, the dispenser having a passageway extending to at least a portion of an interior of the tubular sleeve;

a cap assembly having an inner cap and an outer cap, wherein the inner cap is molded onto the second end of the tubular sleeve, the inner cap having outer threads on an outer side of the inner cap;

wherein the outer cap has a bottom and an outer wall, the outer wall having inner threads configured to engage with the outer threads of the outer side of the inner cap;

wherein the second opening allows access to the cavity of the tubular sleeve; and wherein an outer diameter of outer wall of the outer cap and the outer diameter of the tubular sleeve are the same.

* * * * *